US005725030A

United States Patent [19]

Berger et al.

[11] Patent Number: 5,725,030

[45] **Date of Patent: *Mar. 10, 1998**

[54] FUEL DISPENSING SYSTEM AND METHODS OF MAKING THE SAME

[75] Inventors: Jeffrey M. Berger, Springfield; Randy C. Foster, Strafford; Timothy J. Hampton, Willard; Jack S. Hargus, Marshfield; Richard L. Marsh, Springfield, all of Mo.; David A. Masseth, La Habra, Calif.

[73] Assignee: Dayco Products, Inc., Dayton, Ohio

[ * ] Notice: The term of this patent shall not extend beyond the expiration date of Pat. No. 5,622,212.

[21] Appl. No.: 803,562

[22] Filed: Feb. 20, 1997

Related U.S. Application Data

[62] Division of Ser. No. 514,041, Oct. 2, 1995, Pat. No. 5,622,212, which is a division of Ser. No. 304,994, Sep. 13, 1994, Pat. No. 5,456,296, which is a division of Ser. No. 151,093, Nov. 12, 1993, Pat. No. 5,361,810, which is a division of Ser. No. 962,537, Oct. 16, 1992, Pat. No. 5,305,806.

[51] Int. Cl.[6] ..... B65B 3/18; B67D 5/06

[52] U.S. Cl. ..... 141/59; 141/44; 141/46; 141/302

[58] Field of Search ..... 141/44, 45, 46, 141/59, 301, 302

[56] References Cited

U.S. PATENT DOCUMENTS

| | | | |
|---|---|---|---|
| 5,305,806 | 4/1994 | Berger et al. | 141/59 |
| 5,361,810 | 11/1994 | Berger et al. | 141/59 |
| 5,456,296 | 10/1995 | Berger et al. | 141/59 |
| 5,622,212 | 4/1997 | Berger et al. | 141/59 |

*Primary Examiner*—Henry J. Recla
*Assistant Examiner*—Steven O. Douglas
*Attorney, Agent, or Firm*—Joseph V. Tassone

[57] ABSTRACT

A fuel dispensing system, parts therefor and methods for making the same are provided, the system having a venturi section for removing liquid from a normal drape area of a hose assembly of the system, the venturi section having an inlet unit that is positioned in a vapor recovery fluid passage of the hose assembly generally at the actual drape area of the hose assembly even when the actual drape area is disposed intermediate the normal drape area and a dispensing nozzle or is disposed intermediate the normal drape area and the source of liquid fuel as well as when the actual drape area is disposed generally at the normal drape area.

8 Claims, 15 Drawing Sheets

FIG. 33
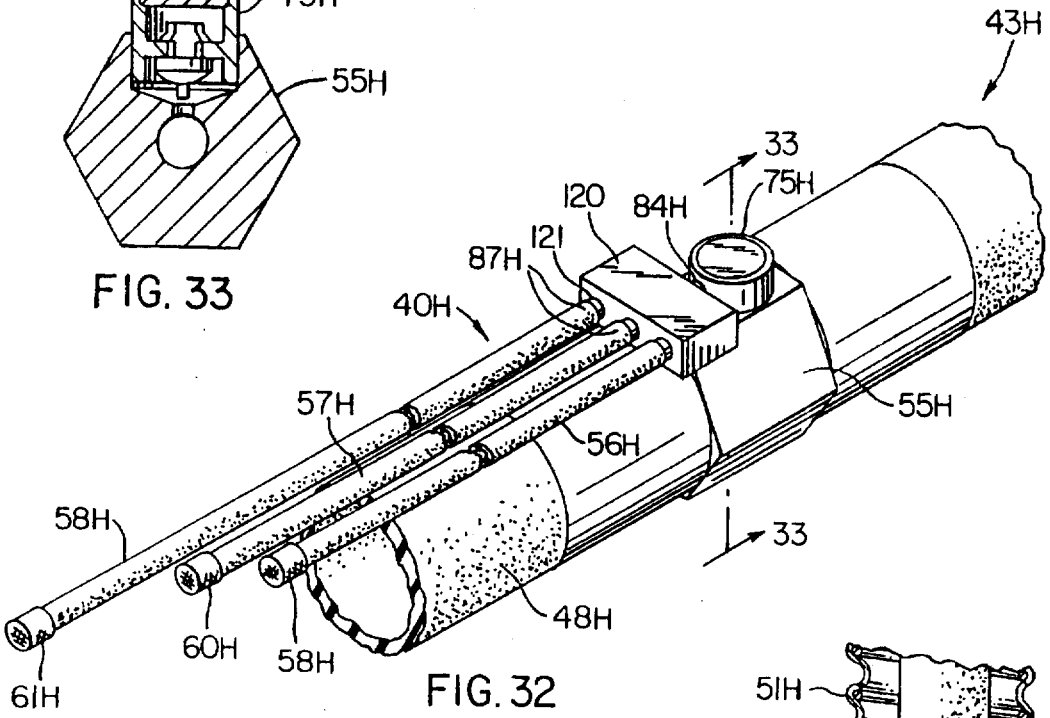
FIG. 32
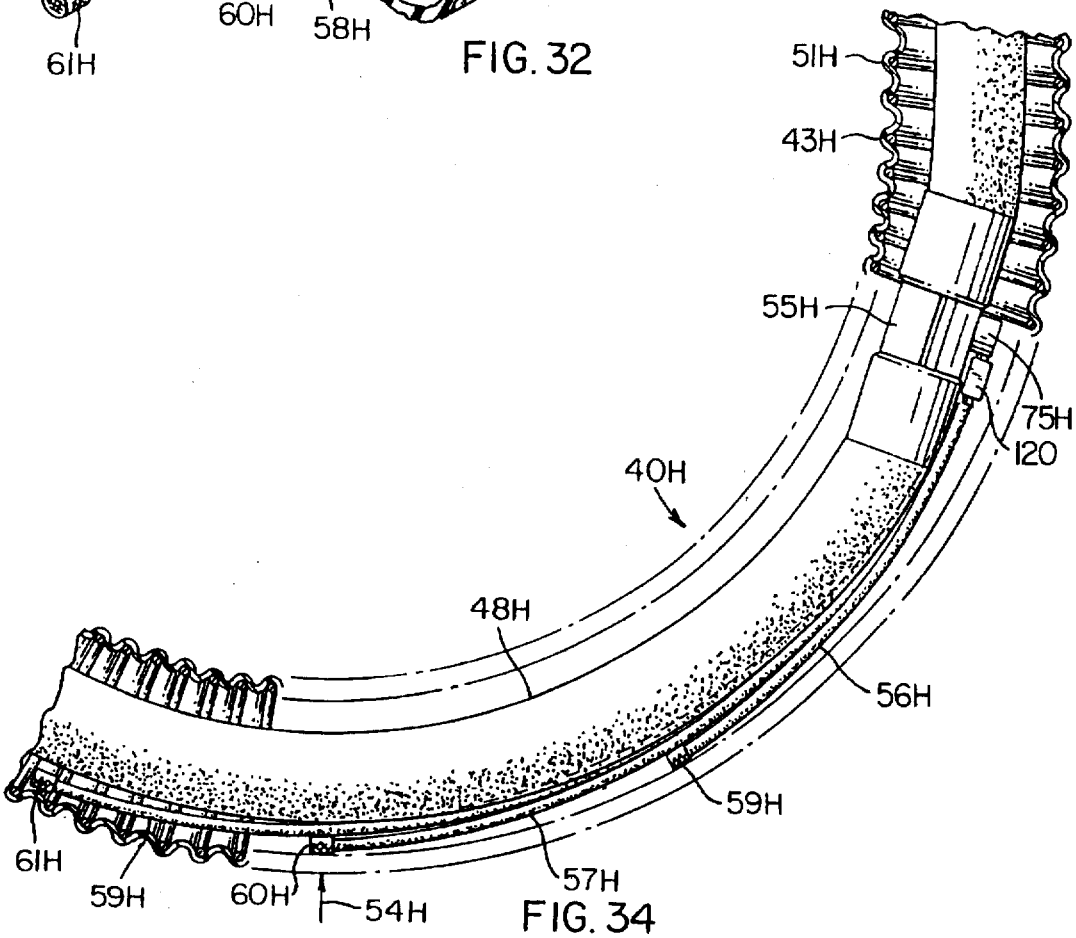
FIG. 34

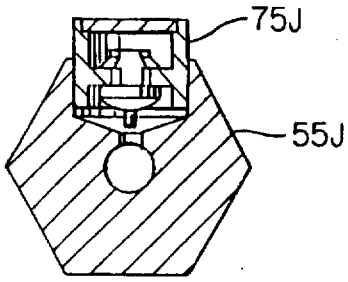
FIG. 39
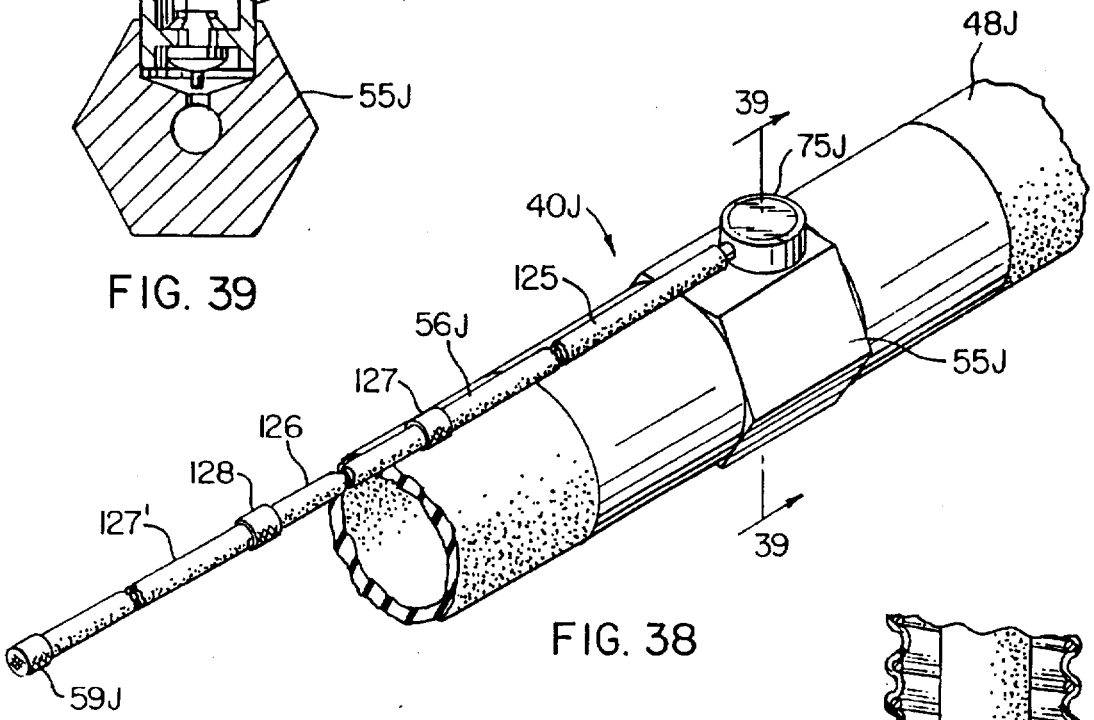
FIG. 38
FIG. 40
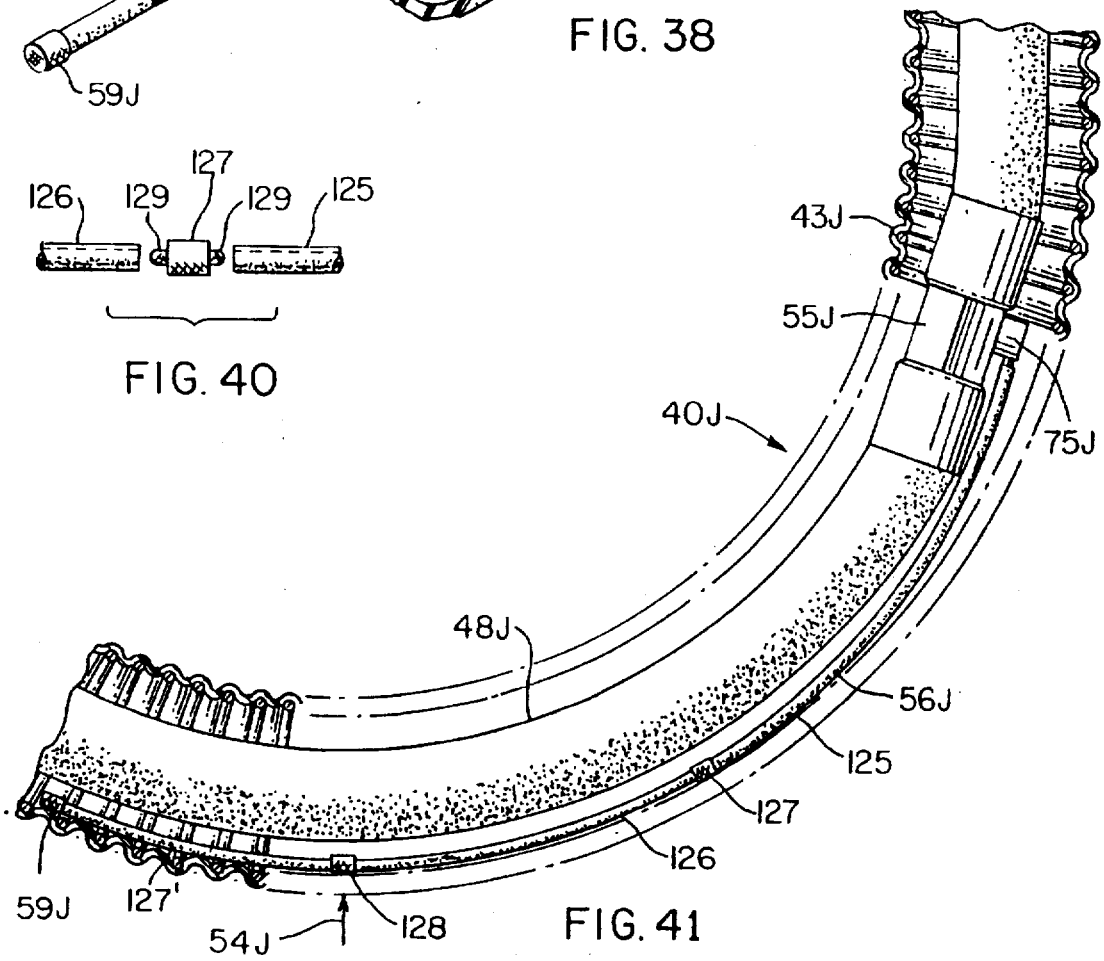
FIG. 41

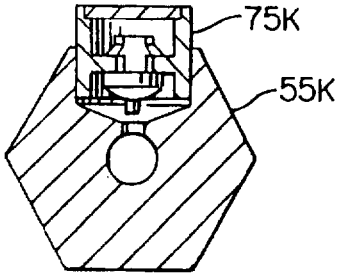
FIG. 43
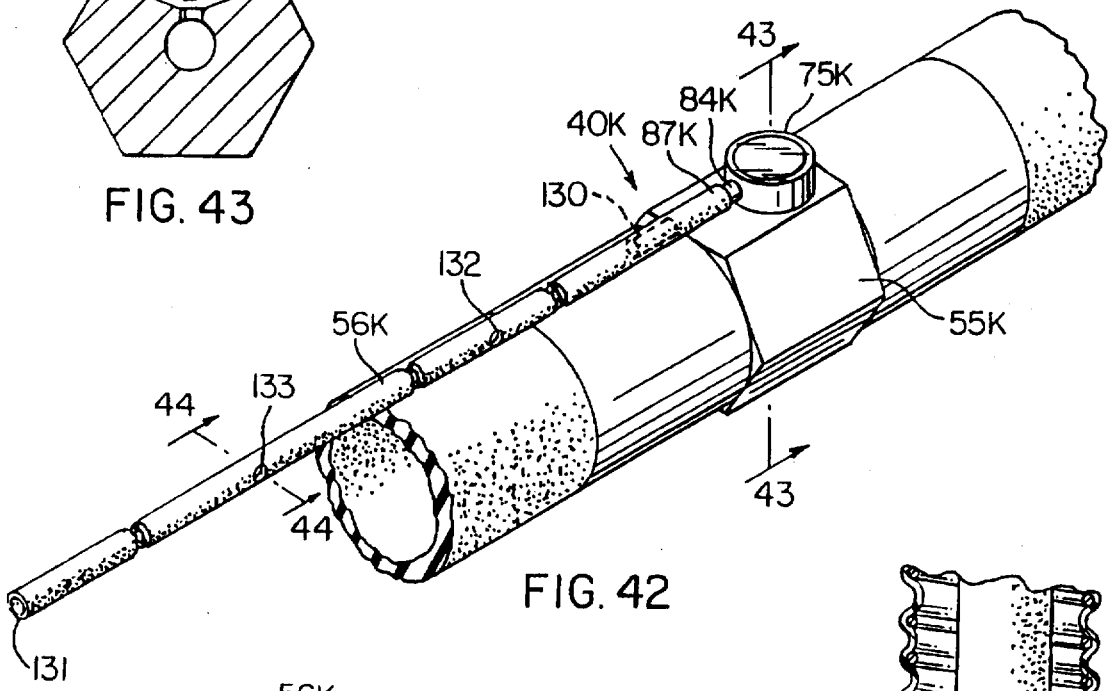
FIG. 42
FIG. 44
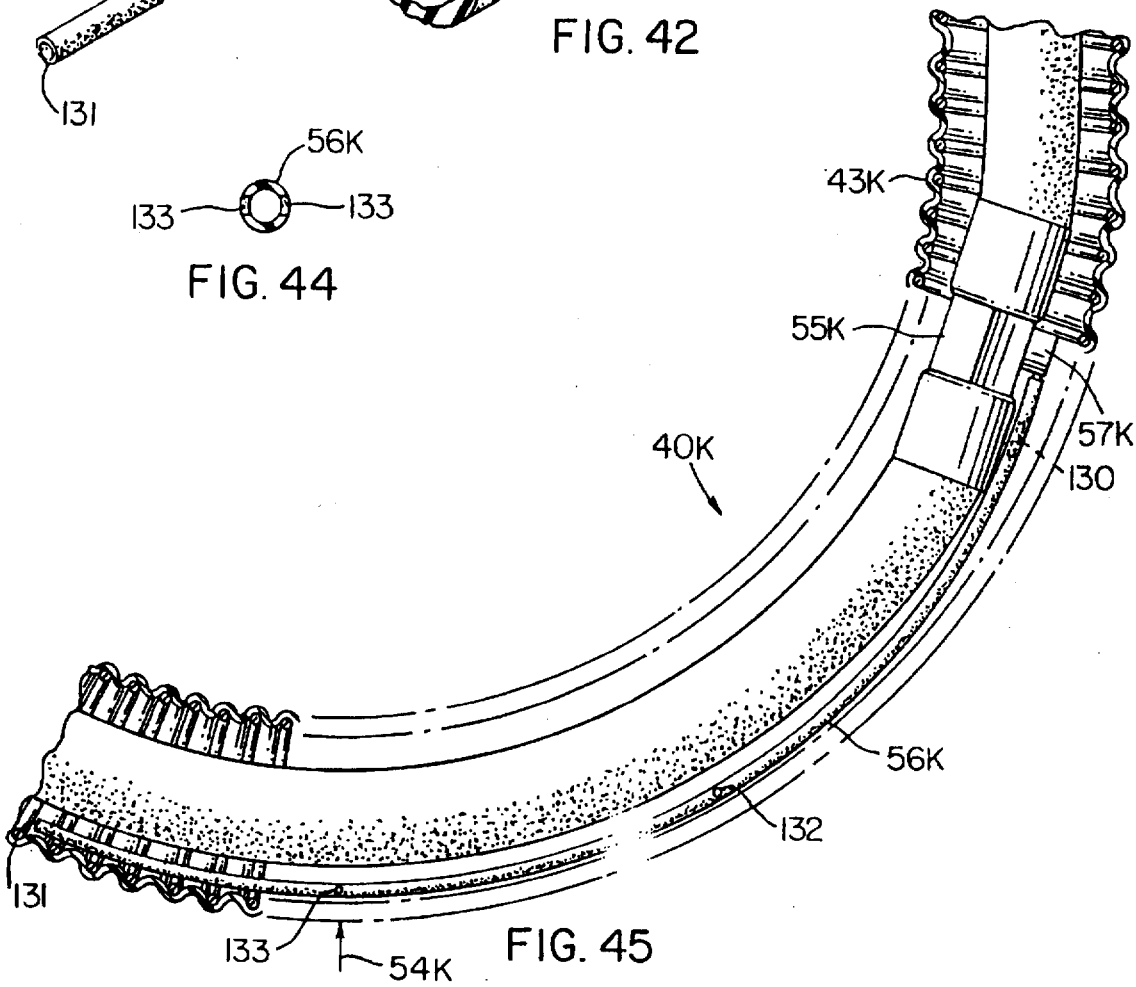
FIG. 45

FUEL DISPENSING SYSTEM AND METHODS OF MAKING THE SAME

CROSS REFERENCE TO RELATED APPLICATIONS

This application is a divisional patent application of its parent patent application, Ser. No. 514,041, filed Oct. 2, 1995, now U.S. Pat. No. 5,622,212; which in turn is a divisional patent application of its parent patent application, Ser. No. 304,994, filed Sep. 13, 1994, now U.S. Pat. No. 5,456,296, issued Oct. 10, 1995; which, in turn, is a divisional patent application of its parent patent application, Ser. No. 151,093, filed Nov. 12, 1993, now U.S. Pat. No. 5,361,810, issued Nov. 8, 1994; which, in turn, is a divisional patent application of its parent patent application, Ser. No. 962,537, filed Oct. 16, 1992, now U.S. Pat. No. 5,305,806, issued Apr. 26, 1994.

BACKGROUND OF THE INVENTION

1. Field of the Invention

This invention relates to a new fuel dispensing system, to a new hose assembly for such a system and to a new venturi section for such a hose assembly as well as to new methods of making such a system, such a hose assembly and such a venturi section.

2. Prior Art Statement

It is known to provide a system comprising a liquid fuel source, a dispensing nozzle and a hose assembly having a first fluid passage therein for conveying the liquid fuel in one direction from the source to the nozzle that dispenses the liquid fuel into a container and a second fluid passage therein for returning the vapors of the liquid fuel from the container, the hose assembly comprising a flexible inner hose having an outer peripheral surface and defining the first fluid passage therein, and a flexible outer hose having an inner peripheral surface and being disposed around the inner hose, the inner peripheral surface of the outer hose and outer peripheral surface of the inner hose defining the second fluid passage therebetween, the system having a venturi section therein that tends to remove liquid from a normal drape area of the hose assembly when the same is being utilized to dispense the liquid into the container. For example, see the Furrow et al, U.S. Pat. No. 4,687,033; the Faeth, U.S. Pat. No. 4,967,809 and the Walker et al, U.S. Pat. No. 5,056,569.

SUMMARY OF THE INVENTION

It is one of the features of this invention to provide a new fuel dispensing system wherein liquid in the drape area of the hose assembly can be removed by the venturi section of the hose assembly even when the actual drape area of the hose assembly is different than the intended normal drape area thereof.

In particular, it has been found that when a hose assembly has been designed to have a normal drape area to be evacuated by a venturi section of the fuel dispensing system utilizing such a hose assembly, not only are such hose assemblies utilized with different dispensing pumps that have different height connections for the hose assemblies to thereby define different actual drape areas for the hose assemblies interconnected thereto when dispensing fuel to fill pipes of vehicles, but also the fill pipes for different vehicles are at different height locations thereby causing different drape areas for the hose assemblies than the normal drape areas for particular hose assemblies.

Therefore, it was found according to the teachings of this invention that the venturi section for a particular fluid dispensing system can be provided with unique inlet means to permit the hose assembly to have an actual drape area which is disposed intermediate the normal drape area thereof and the dispensing nozzle or have an actual drape area that is disposed intermediate the normal drape area and the liquid fuel source as well as to have an actual drape area that is disposed generally at the normal drape area of the hose assembly, such inlet means permitting the venturi section to remove liquid from the actual drape area in all of such positions of the hose assembly.

For example, one embodiment of this invention comprises a system comprising a liquid fuel source, a dispensing nozzle and a hose assembly having a first fluid passage therein for conveying the liquid fuel in one direction from the source to the nozzle that dispenses the liquid fuel into a container and a second fluid passage therein for returning the vapors of the liquid fuel from the container, the hose assembly comprising a flexible inner hose having an outer peripheral surface and defining the first fluid passage therein, and a flexible outer hose having an inner peripheral surface and being disposed around the inner hose, the inner peripheral surface of the outer hose and the outer peripheral surface of the inner hose defining the second fluid passage therebetween, the system having a venturi section therein that tends to remove liquid from a normal drape area of the hose assembly when the same is being utilized to dispense the liquid fuel into the container, the venturi section having inlet means that is positioned in the second fluid passage generally at the actual drape area of the hose assembly even when the actual drape area is disposed intermediate the normal drape area and the nozzle or is disposed intermediate the normal drape area and the source as well as when the actual drape area is disposed generally at the normal drape area.

Accordingly, it is an object of this invention to provide a new system having one or more of the novel features of this invention as set forth above or hereinafter shown or described.

Another object of this invention is to provide a new method of making such a system, the method of this invention having one or more of the novel features of this invention as set forth above or hereinafter shown or described.

Another object of this invention is to provide a new hose assembly for such a system, the hose assembly of this invention having one or more of the novel features of this invention as set forth above or hereinafter shown or described.

Another object of this invention is to provide a new method of making such a hose assembly, the method of this invention having one or more of the novel features of this invention as set forth above or hereinafter shown or described.

Another object of this invention is to provide a new venturi section for such a system, the venturi section of this invention having one or more of the novel features of this invention as set forth above or hereinafter shown or described.

Another object of this invention is to provide a new method of making such a venturi section, the method of this invention having one or more of the novel features of this invention as set forth above or hereinafter shown or described.

Other objects, uses and advantages of this invention are apparent from a reading of this description which proceeds with reference to the accompany drawings forming a part thereof and wherein:

BRIEF DESCRIPTION OF THE DRAWINGS

FIG. 32 is a view similar to FIG. 29 and illustrates another venturi section of this invention.

FIG. 33 is a cross-sectional view taken on line 33—33 of FIG. 32.

FIG. 34 is a view similar to FIG. 31 and illustrates another hose assembly of this invention utilizing the venturi section of FIGS. 32 and 33.

FIG. 38 is a view similar to view 35 and illustrates another venturi section of this invention.

FIG. 39 is a cross-sectional view taken on line 39—39 of FIG. 38.

FIG. 40 is a fragmentary exploded view illustrating parts of the endless tube of the venturi section of FIG. 38.

FIG. 41 is a view similar to FIG. 37 and illustrates another hose assembly of this invention utilizing the venturi section of FIGS. 38–40.

FIG. 42 is a view similar to FIG. 38 and illustrates another venturi section of this invention.

FIG. 43 is a cross-sectional view taken on line 43—43 of FIG. 42.

FIG. 44 is a cross-sectional view taken on line 44 of FIG. 42.

FIG. 45 is a view similar to FIG. 41 and illustrates another hose assembly of this invention utilizing the venturi section of FIGS. 42–44.

DESCRIPTION OF THE PREFERRED EMBODIMENTS

Figure 1:
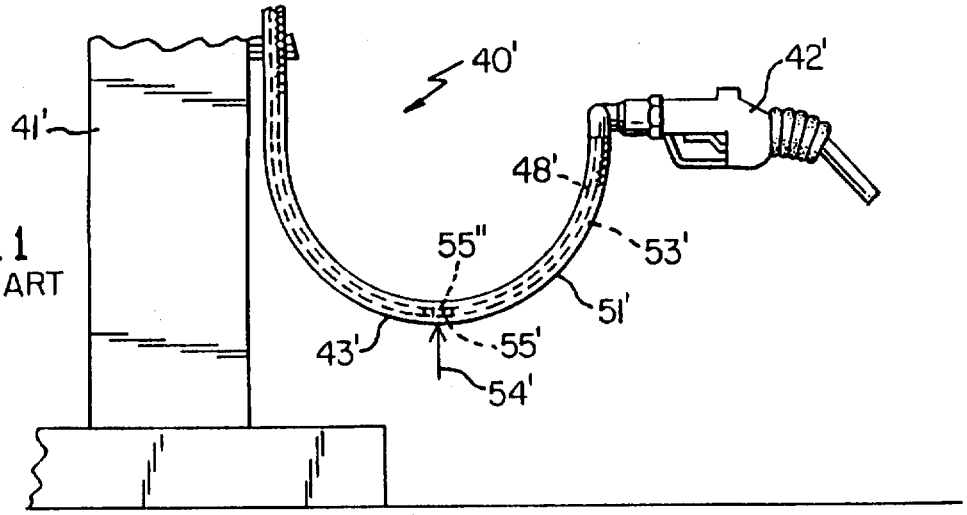
FIG. 1 PRIOR ART
FIG. 1 is a fragmentary, schematic view of a prior known liquid fuel dispensing system.

While the various features of this invention are hereinafter illustrated and described as being particularly adapted to provide a liquid fuel dispensing system utilizing a fuel source pump and a fuel dispensing nozzle of particular types, it is to be understood that the various features of this invention can be utilized singly or in various combinations thereof to provide a dispensing system for other apparatus as desired.

Therefore, this invention is not to be limited to only the embodiments illustrated in the drawings, because the drawings are merely utilized to illustrate one of the wide variety of uses of this invention.

Figure 4:
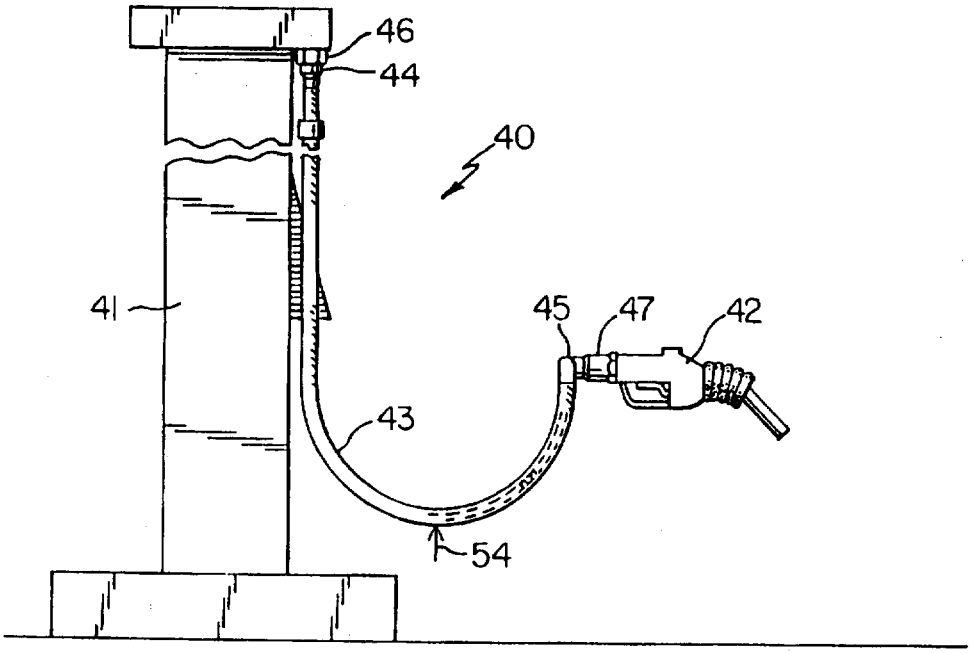
FIG. 4 is a view similar to FIG. 1 and illustrates the new fuel dispensing system of this invention.

Referring now to FIG. 4, the new liquid fuel dispensing system of this invention is generally indicated by the reference numeral 40 and comprises a liquid fuel source 41, such as a curb side fuel pump of a gasoline station or the like, a dispensing nozzle 42 for dispensing fuel from the source 41 into a container, such as the fuel tank of a transportation vehicle, and a hose assembly 43 interconnecting the fuel source 41 to the dispensing nozzle 42.

The hose assembly 43 has suitable coupling means 44 and 45 at the opposed ends thereof for respectively coupling to coupling means 46 and 47 of the fuel source 41 and the nozzle construction 42 all in a manner well known in the art. For example, see the aforementioned three Furrow et al, U.S. Pat. Nos., 4,687,033; Faeth, 4,749,009 and Walker et al, 5,056,569 whereby these three U.S. patents are being incorporated into this disclosure by this reference thereto.

Figure 6:
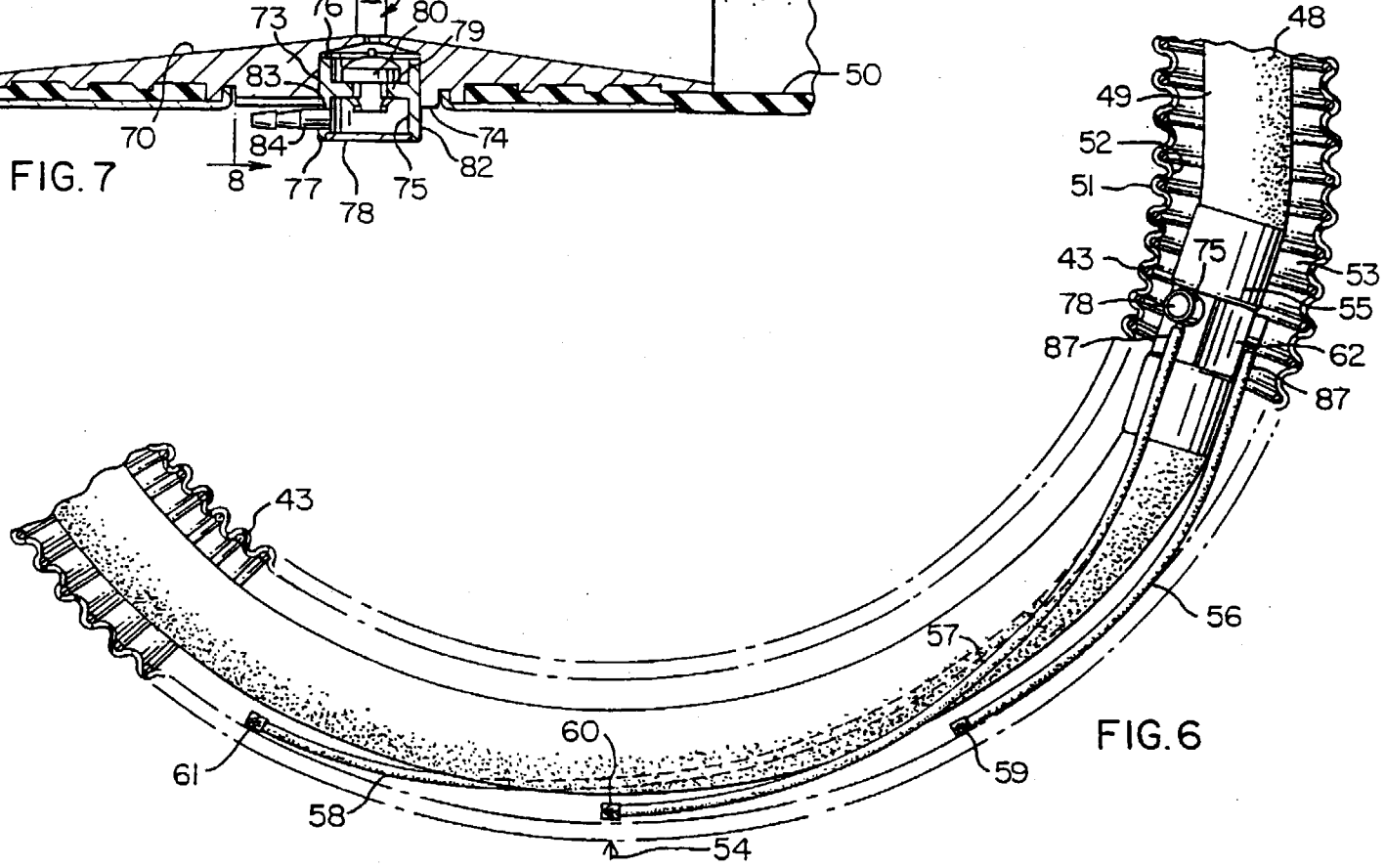
FIG. 6 is an enlarged fragmentary, cross-sectional view of the drape area of the hose assembly of FIG. 4.
Figure 7:
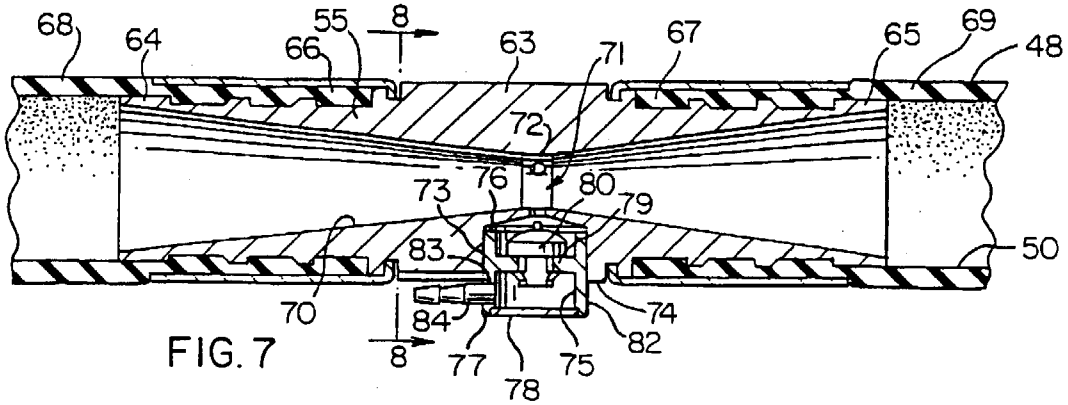
FIG. 7 is an enlarged fragmentary, cross-sectional view of the venturi section of the inner hose of the hose assembly of FIG. 6 without having the inlet tubes thereof interconnected thereto.
Figure 8:
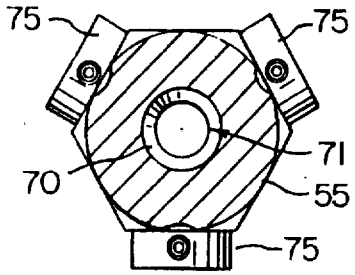
FIG. 8 is a cross-sectional view taken on line 8—8 of FIG. 7.

The hose assembly 43 is best illustrated in FIG. 6 and comprises a flexible inner hose 48 having an outer peripheral surface means 49 and defining a fluid passage 50, FIG. 7, therein that conveys the liquid fuel in one direction from the fuel source 41 to the dispensing nozzle 42. The hose assembly 43 also comprises a flexible outer hose 51 having an inner peripheral surface means 52 and being disposed around the inner hose 48, the inner peripheral surface means 52 of the outer hose 51 and the outer peripheral surface means 49 of the inner hose 48 defining a second fluid passage 53 therebetween for returning the vapors of the liquid fuel from the container into which the liquid fuel is being dispensed by the dispensing means 42, the returning vapors being directed to a vapor recovery system (not shown) that is located at the source 41 all in a manner well known in the art as fully disclosed in the aforementioned three U.S. patents.

As illustrated in FIG. 4, the system 40 is disposed in a fuel dispensing condition thereof wherein the nozzle 42 is being held in a normal position for dispensing fuel into a fuel tank of a vehicle that is pulled alongside the fuel source pump means 41 whereby the hose assembly 43 has an actual low drape area that is indicated by the reference arrow 54 in FIG. 4.

It is well known in the art that liquid fuel tends to collect in the vapor recovery passage 53 at the actual low drape area 54 of the hose assembly 43 and thereby tends to prevent vapors from being returned from the fuel receiving container back to the vapor recovery means of the pump means 41 whereby venturi means, such as venturi section 55, have been utilized to evacuate any liquid that tends to collect in the actual low drape area 54.

In particular, each such prior known venturi means comprises a venturi section that is so arranged in the fuel dispensing system that fuel flows through the venturi section as the fuel is being conveyed from the pump means to the dispensing nozzle and such flow of fuel through the venturi section creates a vacuum in inlet means leading to the venturi section whereby such inlet means is located at the intended or normal low drape area of the hose assembly and in the vapor recovery passage thereof to suck any liquid collecting therein from such area and placing the same back into the flow of liquid fuel from the liquid fuel source to the dispensing nozzle.

The aforementioned Furrow et al, U.S. Pat. No. 4,687,033 locates the inlet means of its venturi section through the use of a single flexible tube having an inlet end that is placed at the intended or normal drape area of the hose assembly.

In contrast, the aforementioned Faeth, U.S. Pat. No. 4,749,009 and the Walker et al, U.S. Pat. No. 5,056,569 each has the venturi section thereof provided with a plurality of spaced apart and circularly arranged inlet means in a medial portion thereof that respectively face outwardly so that by arranging the venturi section to have the medial portion thereof disposed at the intended or normal drape area of the hose assembly, at least one of such inlet means will be pointing generally downwardly to suck liquid from the drape area in the vapor recovery passage thereof as fully disclosed in such patents.

However, as previously stated, it has been found that when the prearranged inlet means of the various venturi sections have been positioned so as to be disposed at the intended or normal drape area of the hose assembly in its dispensing condition, the nozzle may be positioned in other than the expected normal dispensing position thereof and thereby change the actual location of the low drape area from the normal drape area thereof to another position. For example, different vehicles have different locations of the filler pipes for the fuel tanks thereof relative to the ground level where the fuel dispensing pumps are located. Also, such hose assemblies are sold in certain lengths thereof to be utilized with certain fuel dispensing pumps that have the connection means for connecting to the hose assemblies located at a certain distance above the island level. However, it has been found that such hose assemblies have been utilized with dispensing pumps that have different height locations of coupling means for their respective hose assemblies whereby the location of the connection for a particular hose assembly may be higher above the ground or closer to the ground than where it was intended for that particular hose assembly to be connected. Thus, the actual drape area for that hose assembly is different than the expected or normal drape area thereof.

Figure 2:
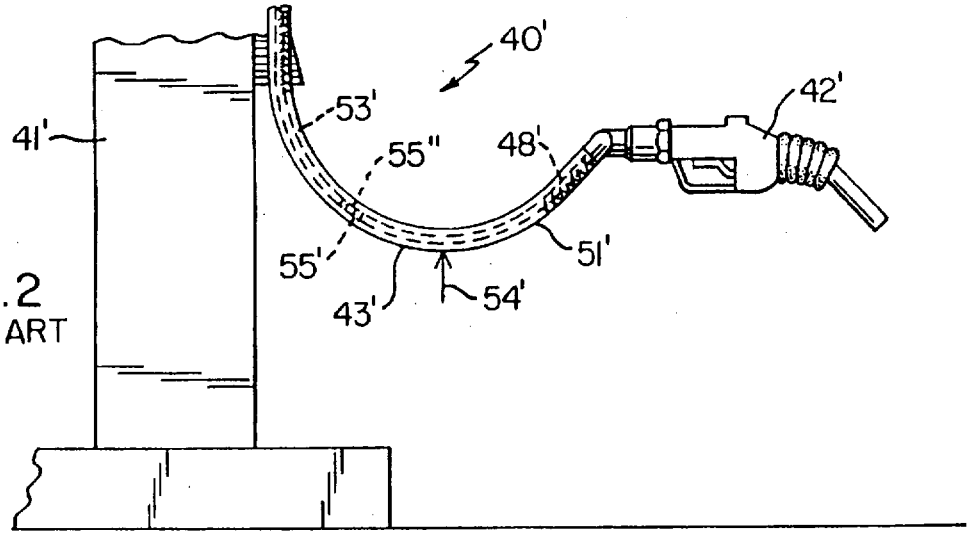
FIG. 2 PRIOR ART
FIG. 2 is a view similar to FIG. 1 and illustrates the prior known fuel dispensing system having a different actual drape area for the hose assembly thereof.
Figure 3:
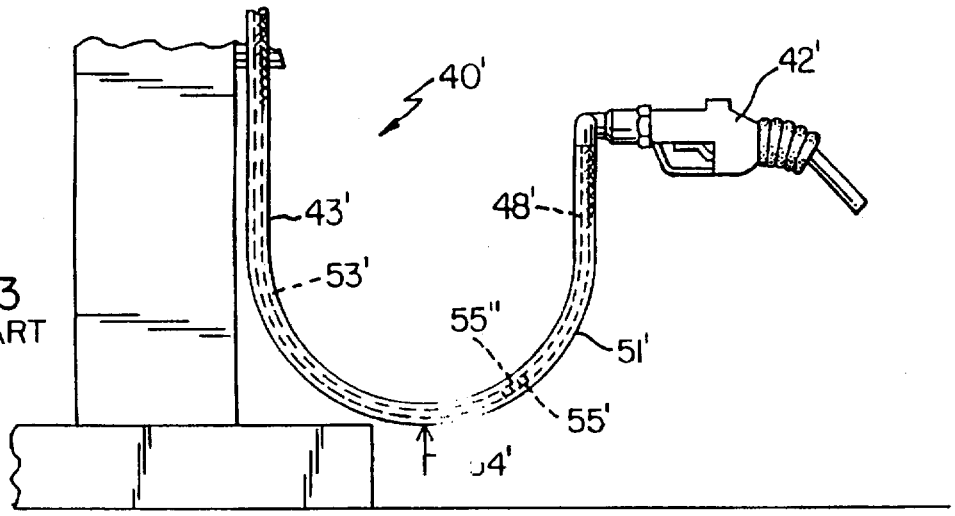
FIG. 3 PRIOR ART
FIG. 3 is a view similar to FIG. 2 and illustrates the prior known fuel dispensing system having another actual drape area for the hose assembly thereof.

For example, reference is now made to FIGS. 1–3 wherein a prior known fuel dispensing system of the aforementioned Walker et al, U.S. Pat. No. to 5,056,569 is generally indicated by the reference numeral 40' and parts thereof similar to the fuel dispensing system 40 of this invention previously described are indicated by like reference numerals followed by a prime mark.

As illustrated in FIG. 1, a venturi section 55' of the inner hose 48' is so disposed in the outer hose 51' and positioned from the dispensing nozzle 42' that the same has its inlet containing medial portion 55" disposed generally at the normal low drape area 54' for which the hose assembly 43' has been designed for dispensing fuel in a normal manner.

However, see FIG. 2 wherein the hose assembly 43' of the system 40' has an actual drape area 54' that is spaced from the venturi section 55' because the hose assembly 43' is connected to a point on the dispensing pump means 41' that is higher than the hose assembly 43' of FIG. 1 and/or the nozzle means 42' is located closer to the ground in its dispensing condition than when in the normal position of FIG. 1.

Conversely, see FIG. 3 wherein the venturi section 55' is located between the actual drape area 54' of the hose assembly 43' and the nozzle means 42' either because the hose assembly 43' is interconnected to a fuel dispensing pump at a location much lower than the normal connecting location as in FIG. 1 or the dispensing nozzle 42' has been raised above the ground level to a dispensing position at a location much higher than the normal position as illustrated in FIG. 1.

In any event, it can be seen from FIGS. 1–3, that the actual drape area 54' of a hose assembly 43' can be disposed intermediate the intended or normal drape area thereof and the dispensing nozzle as illustrated in FIG. 2 or intermediate the fuel dispensing source and the intended or normal drape area as illustrated in FIG. 3 so that the inlet means of the venturi section 55' that are in the location of the medial portion 55" thereof are disposed too far from the actual drape area 54' to evacuate any liquid that would be filling the vapor recovery passage 53' thereof.

Therefore, as previously stated, it is a feature of this invention to provide a fuel dispensing system wherein the venturi section thereof is adapted to have its inlet means compensate for different positionings of the actual low drape area of the hose assembly 43 in the three general conditions illustrated in FIGS. 1, 2 and 3 so as to remove any liquid that collects in such actual drape area thereof.

The system 40 of this invention accomplishes this result by having the venturi section 55 thereof provided with three hollow flexible inlet tubes 56, 57 and 58 formed of any suitable material and respectively having inlet ends 59, 60 and 61 disposed at different distances from a medial portion 62 of the venturi section 55.

For example, when the hose assembly 43 of this invention is disposed in the system 40 so that the actual low drape area 54 of the hose assembly 43 is disposed at the normal drape area thereof as illustrated in FIG. 6, the inlet end 60 of the intermediate tube 57 is positioned in the vapor recovery passage 53 substantially at the actual low drape area 54 as illustrated in FIG. 6 so as to evacuate the actual low drape area 54 thereof through the suction action of the venturi section 55 in a manner well known in the art and fully disclosed in the aforementioned Faeth, U.S. Pat. No. 4,749,009 and the Walker et al, U.S. Pat. No. 5,056,569. However, it can be seen that the inlets 59 and 61 for the respective shorter tube 56 and longer tube 58 are so arranged that the inlet 59 will be disposed at the actual drape area in the condition in FIG. 2 for the hose assembly 43 and the inlet 61 will be disposed at the actual drape area of the hose assembly 43 in the condition of FIG. 3. This is accomplished by forming the hose assembly 43 so as to have the venturi section 55 in the normal dispensing condition thereof disposed intermediate the normal drape area for the hose assembly 43 and the nozzle 42 with the lengths of inlet tubes 56, 57 and 58 being so selected that their respective inlets 59, 60 and 61 will respectively cover the situations illustrated in FIGS. 1, 2 and 3 so as to assure evacuation of liquid that would be collecting in such hose assembly 43 in any of the three generally expected dispensing conditions of that hose assembly 43.

While any suitable dimensions can be utilized for accomplishing such results it has been found that in one working embodiment of this invention, the venturi section 55 should have its medial portion 62 located somewhere between approximately fourteen inches to eighteen inches from the end connection 45 of the hose assembly 43 for the nozzle 42 and since the expected or normal drape area for such a hose assembly 43 would be between approximately twenty-four inches to thirty-seven inches from that end 45 of the hose assembly 43, the inlet end 59 of the hose 56 should be approximately six inches from the medial portion 62 of the venturi section 55, the inlet end 60 of the inlet tube 57 should be disposed approximately twelve inches form the medial portion 62 of the venturi section 55 and the inlet end 61 of the longer inlet tube 58 should be disposed approximately eighteen inches from the medial portion 62 of the venturi section 55.

It has also been found that the inlet ends 59, 60 and 61 of the inlet tubes 56, 57 and 58 should be formed from a filtering material so as to filter the liquid being sucked into the tubes 56, 57 and 58 by the venturi section 55 and the same can comprise stone filters which have sufficient weight so as to cause the inlet ends 50, 60 and 61 to tend to readily fall by gravity to the bottom of the vapor recovery passage 53 in the manner illustrated in FIG. 6 regardless of the rotational position of the inner hose 48, and, thus, the rotational position of venturi section 55 in the outer hose 51 in its assembled condition with the fuel source pump means 41 and nozzle 42.

The venturi section 55 is best illustrated in FIG. 7 and comprises a metallic member 63 having opposed ends 64 and 65 respectively interconnected to inner ends 66 and 67 of flexible sections 68 and 69 of the inner hose 48 all in a manner which is fully set forth in the Grantham, U.S. Pat. No. 4,951,720 whereby this U.S. patent is also being incorporated into this disclosure by this reference thereto.

The venturi member 63 has a venturi passage 70 passing therethrough and defining a venturi throat 71 which is adapted to cause a suction in a plurality of inlet ports 72 intersecting with such throat 71 and leading to enlarged openings 73 that interrupt the outer peripheral surface 74 of the member 63 and respectively receive inlet members 75 therein, three such ports 72 and, thus, three such inlet members 75 being provided for the venturi member 63.

Figure 9:
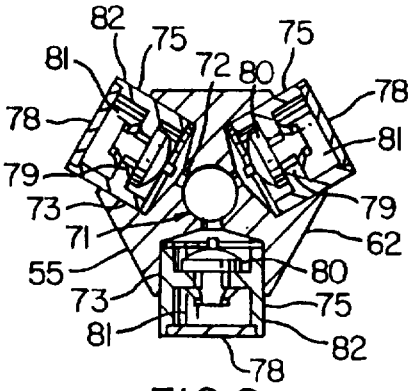
FIG. 9 is a cross-sectional view taken on line 9—9 of FIG. 5.

Each inlet member 75 is a substantially cylindrical metallic member that has opposed open ends 76 and 77 with the end 77 being sealed closed by a metallic end cap or disc 78 while the other end 76 remains open to its respective port 72 as illustrated in FIGS. 7 and 9. A valve seat means 79 is disposed intermediate the ends 76 and 77 of each inlet member 75 and carries a one-way check valve means 80 that permits fluid to be drawn through the valve means 79 in a direction toward the venturi throat 71 while preventing fluid from the throat 71 from flowing back to the end 77 through the valve seat means 79 all in a manner well known in the art and as fully set forth in the aforementioned U.S. patents to Faeth, Walker et al and Grantham.

Thus, it can be seen that in each inlet member 75, a chamber 81 is defined between the valve seat means 79 and the end cap 78 that has a suction created therein when fuel flows through the venturi passage 70 of the venturi section 55.

Figure 5:
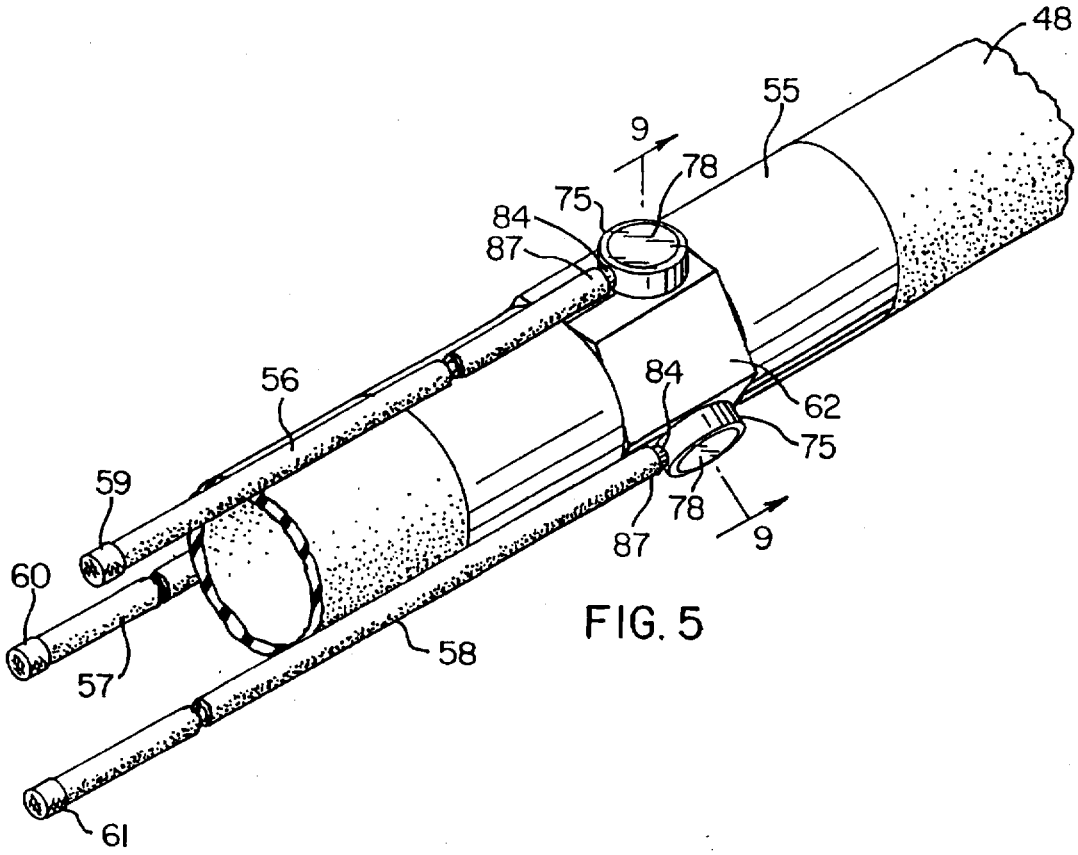
FIG. 5 is an enlarged fragmentary perspective view of the inner hose and venturi section for the hose assembly of the system of FIG. 4.

A side wall part 82 of each member 75 extends beyond the external peripheral surface 74 of the venturi member 63 and an opening 83 is formed through this side wall portion 82. A hollow nipple member 84 formed of any suitable material has one end 85 thereof secured in the opening 83 in any suitable manner while another free end 86 of the nipple member 84 is adapted to hold a respective end 87 of its respective inlet tube 56, 57 or 58 when forced thereon in a telescoping manner as fully illustrated in FIGS. 5, 6 and 10. Thus, it can be seen that each inlet member 75 permits the inlet tubes 56, 57 and 58 to draw liquid from their respective inlet ends 59, 60 and 61 into the throat area 71 of the venturi member 63 when liquid fuel flows through the venturi passage 70 of the venturi section 55 for the reasons fully set forth in the aforementioned U.S. patents that have been previously incorporated into this disclosure.

Thus, it can be seen that the system 40 of this invention readily permits any of the inlet hoses 56, 57 or 58 to have its respective end 59, 60 or 61 disposed generally at the actual drape area 54 of the hose assembly 43 with the venturi section 55 evacuating any liquid accumulating in such actual drape area 54 in the vapor recovery passage 53 through the suction being created by the venturi section 55 all in a manner well known in the art while permitting the hose assembly 43 to have the actual drape area 54 thereof disposed at an expected normal drape area as in FIG. 1 or FIG. 6, or at a drape area that is disposed on either side of that normal drape area as illustrated respectively in FIGS. 2 and 3.

Figure 12:
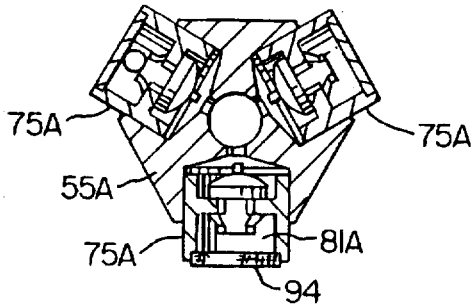
FIG. 12 is a cross-sectional view taken on line 12—12 of FIG. 11.
Figure 11:
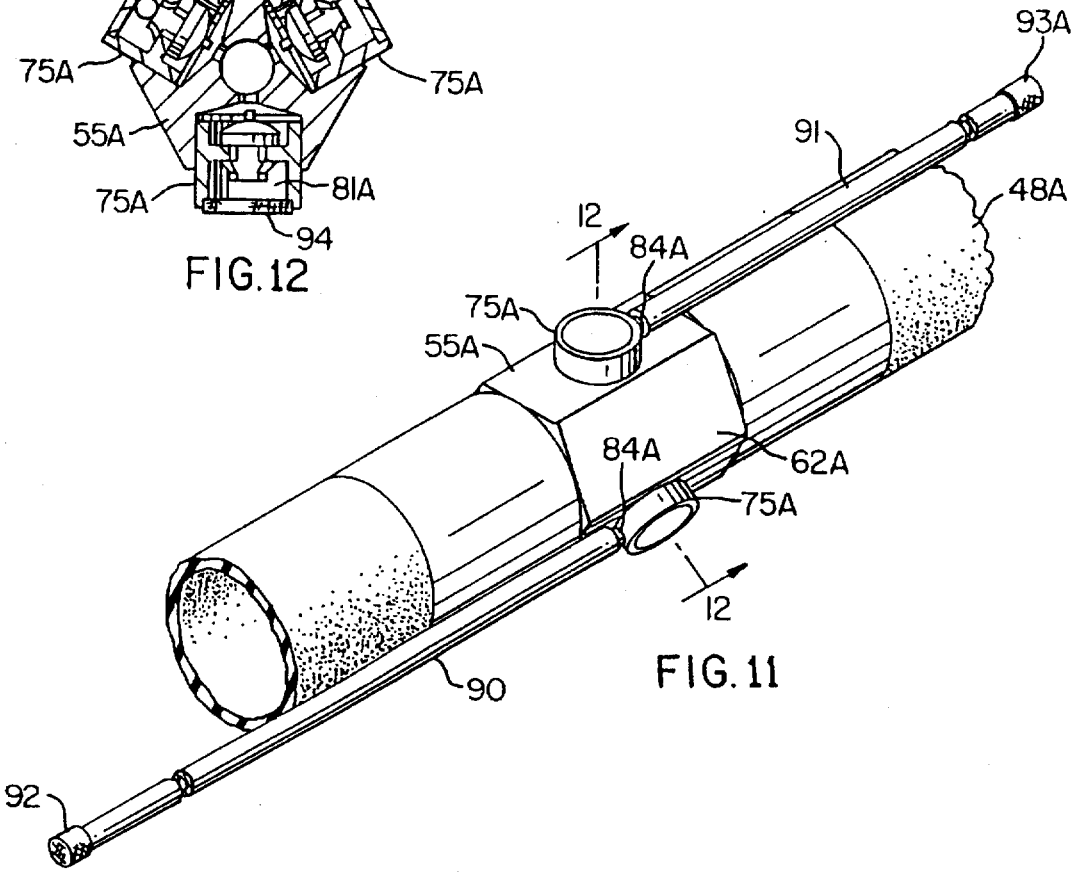
FIG. 11 is a view similar to FIG. 4 and illustrates another venturi section of this invention.
Figure 13:
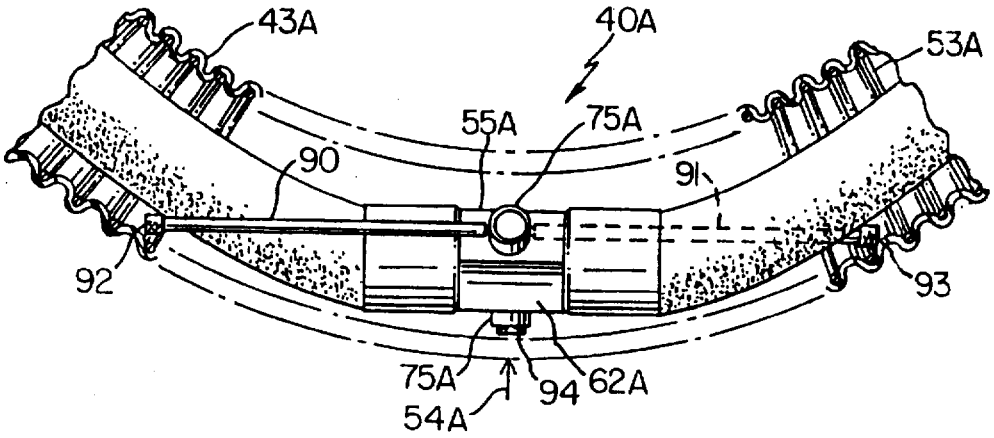
FIG. 13 is a view similar to FIG. 6 and illustrates another hose assembly of this invention utilizing the venturi section of FIGS. 11 and 12.

Another fuel dispensing system of this invention is generally indicated by the reference numeral 40A in FIGS. 11–13 and parts thereof similar to the parts of the system 40 previously described are indicated by like reference numerals followed by the reference letter "A".

As illustrated in FIGS. 11–13, the system 40A is substantially identical to the system 40 previously described except that the hose assembly 43A has the venturi section 55A thereof provided with two rigid inlet tubes 90 and 91 respectively interconnected to the nipple means 84A of two of the inlet housing means 75A so as to respectively have their inlet free ends 92 and 93 thereof extending in opposite directions from the medial portion 62A of the venturi section 55A as illustrated in FIGS. 11 and 13.

The remaining inlet housing member 75A of the venturi section 55A has a filter disc-like member 94 closing the chamber 81A thereof so that the chamber 81A can suck liquid through the filter member 94 into the chamber 81A without utilizing an inlet tube therefor in the same manner as the venturi tubes of the aforementioned U.S. patents to Faeth and Walker et al.

In this manner, the flat filter 94 will be located in the normal low drape area 54A as illustrated in FIG. 13 so as to clear any liquid from the vapor recovery passage means 53A when the normal drape area is the actual drape area 54A of the hose assembly 43A as illustrated in FIG. 13. However, the inlet end 93 of the inlet tube 91 would be disposed at the actual drape area when the hose assembly 43A is positioned in the manner illustrated in FIG. 2 and the inlet end 92 of the inlet tube 90 would be disposed at the actual low drape area when the hose assembly 93A is disposed in the condition illustrated in FIG. 3.

Therefore, it can be seen that the system 40A functions in a manner similar to the system 40 previously described so as to provide inlet means to the venturi section 55A in all of the positions illustrated in FIGS. 1, 2 and 3.

Figure 14:
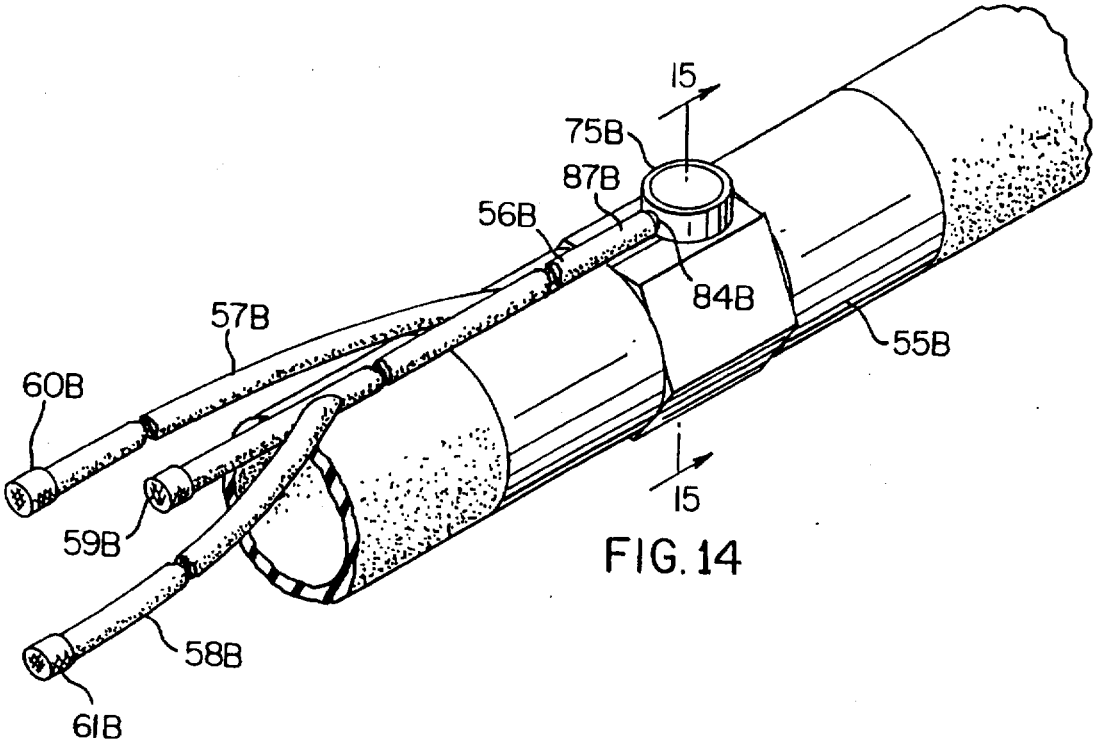
FIG. 14 is a view similar to FIG. 11 and illustrates another venturi section of this invention.
Figure 15:
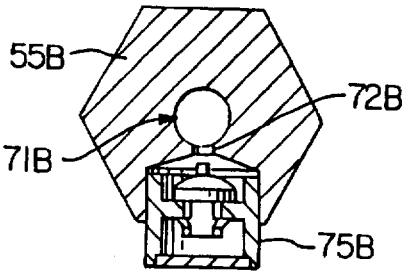
FIG. 15 is a cross-sectional view taken on line 15—15 of FIG. 14.
Figures 10, 16:
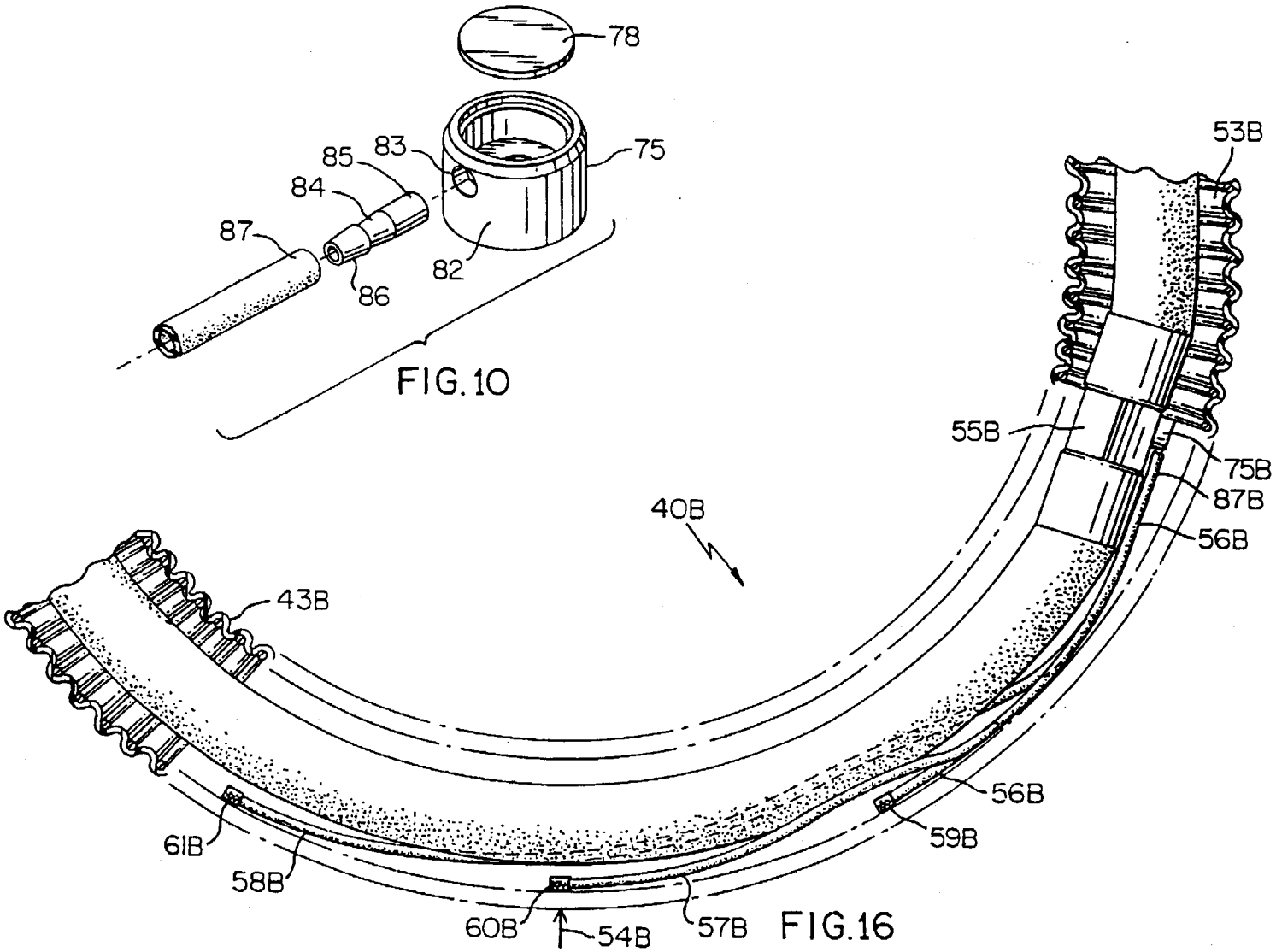
FIG. 10 is an exploded perspective view of the various parts for attaching an inlet hose to one of the inlet openings in the venturi section of FIGS. 4–9.
FIG. 16 is a view similar to FIG. 13 and illustrates another hose assembly of this invention utilizing the venturi section of FIGS. 14 and 15.

Another fuel dispensing system of this invention is generally indicated by the reference numeral 40B in FIGS. 14–16 and parts thereof similar to the fuel dispensing systems 40 and 40A previously described are indicated by like reference numerals followed by the reference letter "B"

As illustrated in FIGS. 14–16, the system 40B is substantially identical to the system 40 previously described except that the venturi section 55B for the hose assembly 43B has only a single outlet housing member 75B provide it with a single flexible tubular member 56B having its inner end 87B secured in telescoping relation on the nipple 84B, the outer end 59B of the tubular member 56B being adapted to be disposed in the vapor recovery passage 53B as illustrated in FIG. 16 so as to permit the hose assembly 43B to utilize the inlet end 59B when the hose assembly 43B has the actual low drape area 54B thereof disposed in the position of FIG. 2 as previously described for the system 40.

However the tubular member 56 has the ends 87B of the flexible tubular members 57B and 58B directly interconnected thereto intermediate the ends 59B and 87B thereof so that the single inlet member 75B will provide suction through all of the tubular member 56B, 57B and 58B to respectively act on the inlet ends 59B, 60B and 61B thereof with the ends 60B and 61B being respectively disposed as illustrated in FIG. 16 so that the inlet end 60B will be disposed at the actual low drape area 54B of the hose assembly 43B when the actual drape area 54B is the normal low drape area thereof as illustrated in FIG. 1 and the inlet end 61B will be disposed at the actual low drape area 54B when the actual low drape area 54B is created in the manner illustrated in FIG. 3 for the hose assembly 43B in the same manner as the system 40 previously described.

Therefore, it can be seen that the venturi section 55B only needs one inlet port 72B to the venturi throat 71B thereof as illustrated in FIG. 15 and will still provide for three different pick-ups in the vapor recovery passage 53B in the manner previously set forth.

Figure 18:
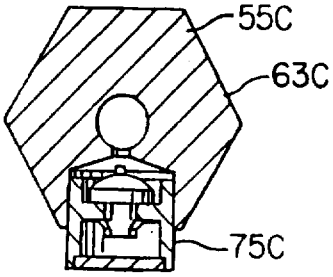
FIG. 18 is a cross-sectional view taken on line 18—18 of FIG. 17.
Figure 17:
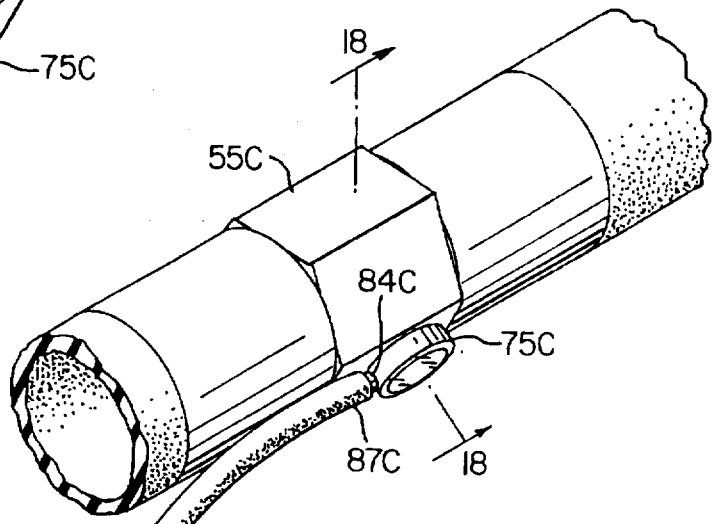
FIG. 17 is a view similar to FIG. 14 and illustrates another venturi section of this invention.
Figure 19:
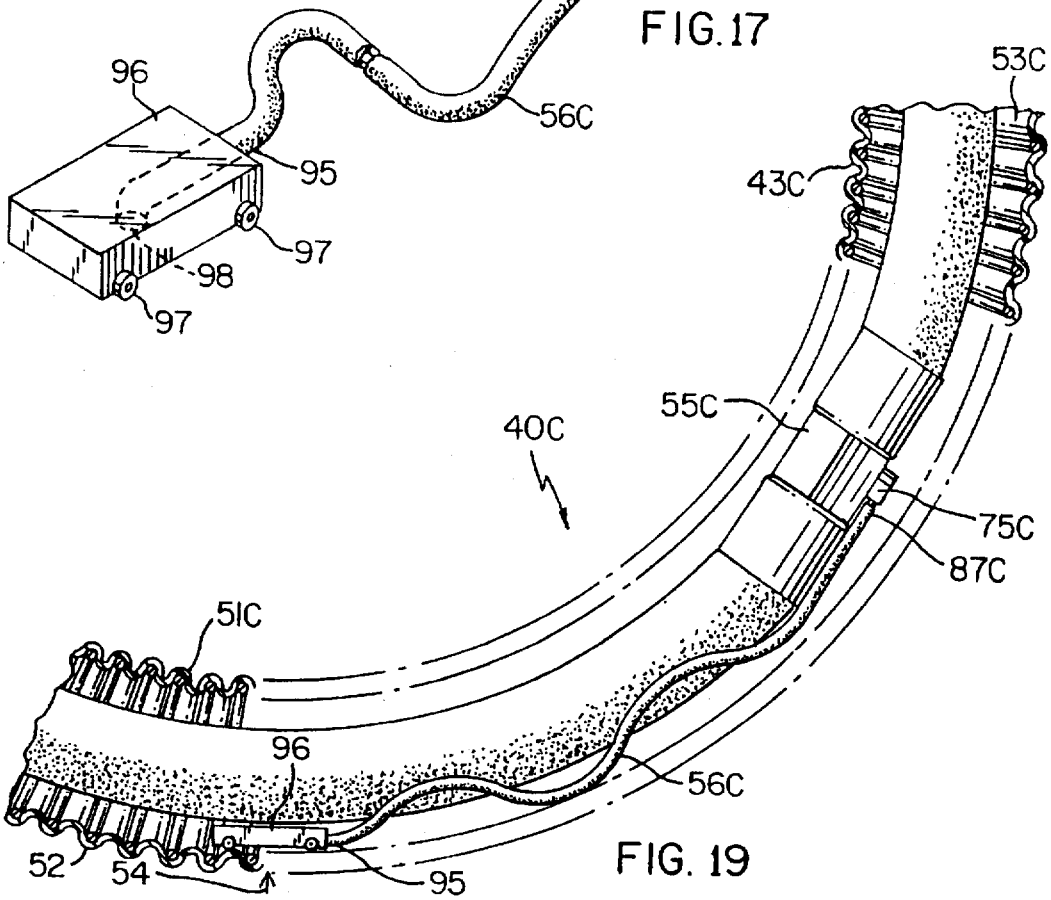
FIG. 19 is a view similar to FIG. 16 and illustrates another hose assembly of this invention utilizing the venturi section of FIGS. 17 and 18.

Another fuel dispensing system of this invention is generally indicated by the reference numeral 40C in FIGS. 17–19 and parts thereof similar to the parts of the fuel dispensing systems 40–40B previously described are indicated by like reference numerals followed by the reference letter "C".

As illustrated in FIG. 19, the venturi section 55C of the hose assembly 43C also has only a single inlet member 75C provided for the venturi member 63C so that only a single flexible inlet tube 56C has its end 87C secured on to the nipple member 84C of the inlet member 75C as illustrated in FIG. 17. The other end 95 of the inlet tube 56C is interconnected to a block-like member 96 that has a plurality of wheels 97 so as to permit the member 96 to roll on the internal peripheral surface 52C of the outer hose 51C and position itself by gravity at the actual low drape area 54C of the hose assembly 43C regardless of whether the low area 54C is in the normal low drape area as illustrated in FIG. 1 or in the other conditions as illustrated in FIGS. 2 and 3 (as well as in other locations within the length of the tube 56C) as the length of the tube 56C is sufficient to permit such positioning of the movable member 96 to such positions within the vapor recovery passage 53C.

The wheeled member 96 has a filtered inlet 98 illustrated in FIG. 17 that is fluidly interconnected to the tube 56C and that is adapted to face downwardly toward the internal peripheral surface 52C of the outer hose 51C and is medially disposed at the bottom surface 99 of the wheeled member 96 so as to suck liquid from the vapor recovery passage 53C at the actual low drape area 54C thereof for the reasons previously set forth whereby the wheeled inlet member 96 will be disposed in different positions depending upon the actual low drape area 54C of the hose assembly 43C.

Figure 21:
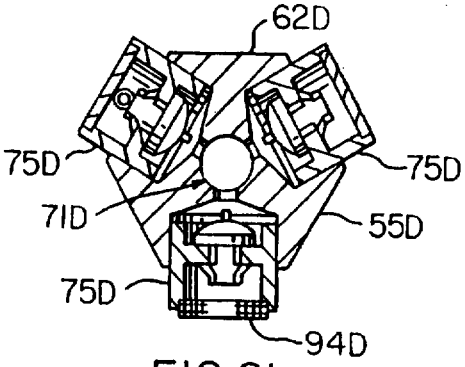
FIG. 21 is a cross-sectional view taken on line 21—21 of FIG. 20.
Figure 20:
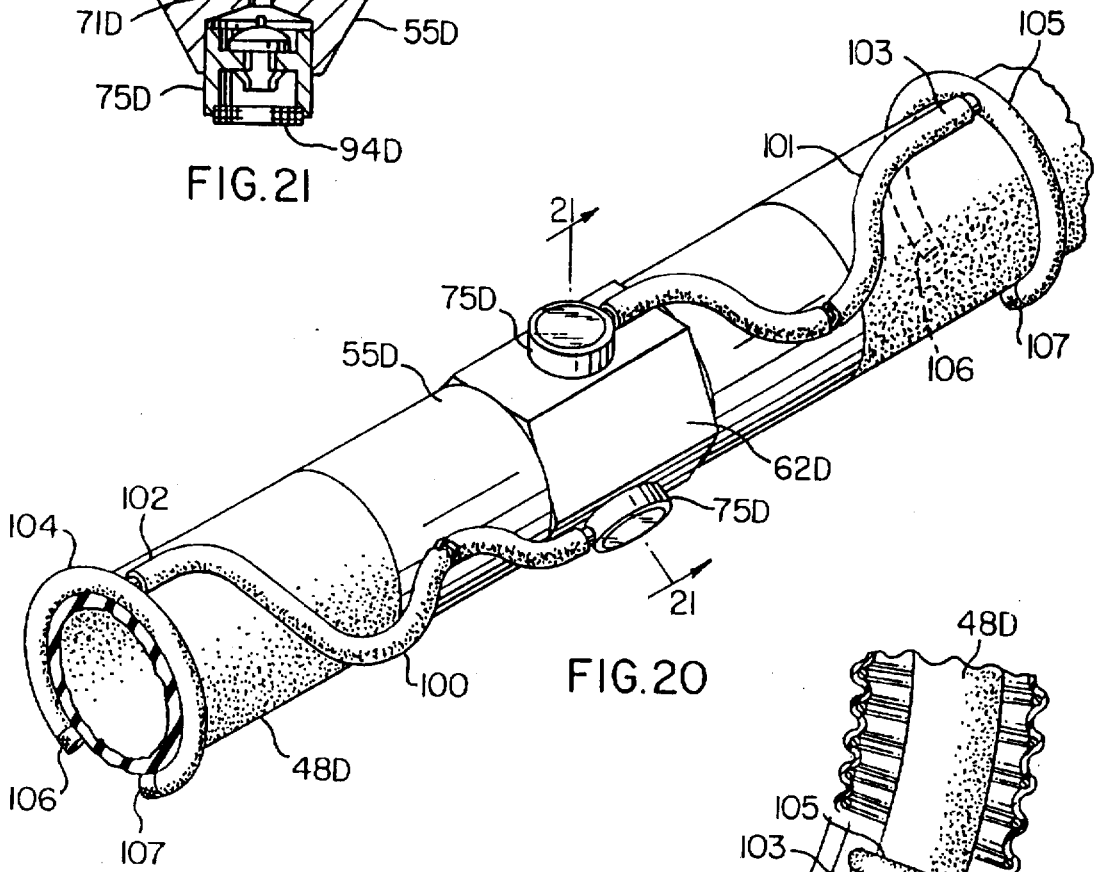
FIG. 20 is a view similar to FIG. 17 and illustrates another venturi section of this invention.
Figure 22:
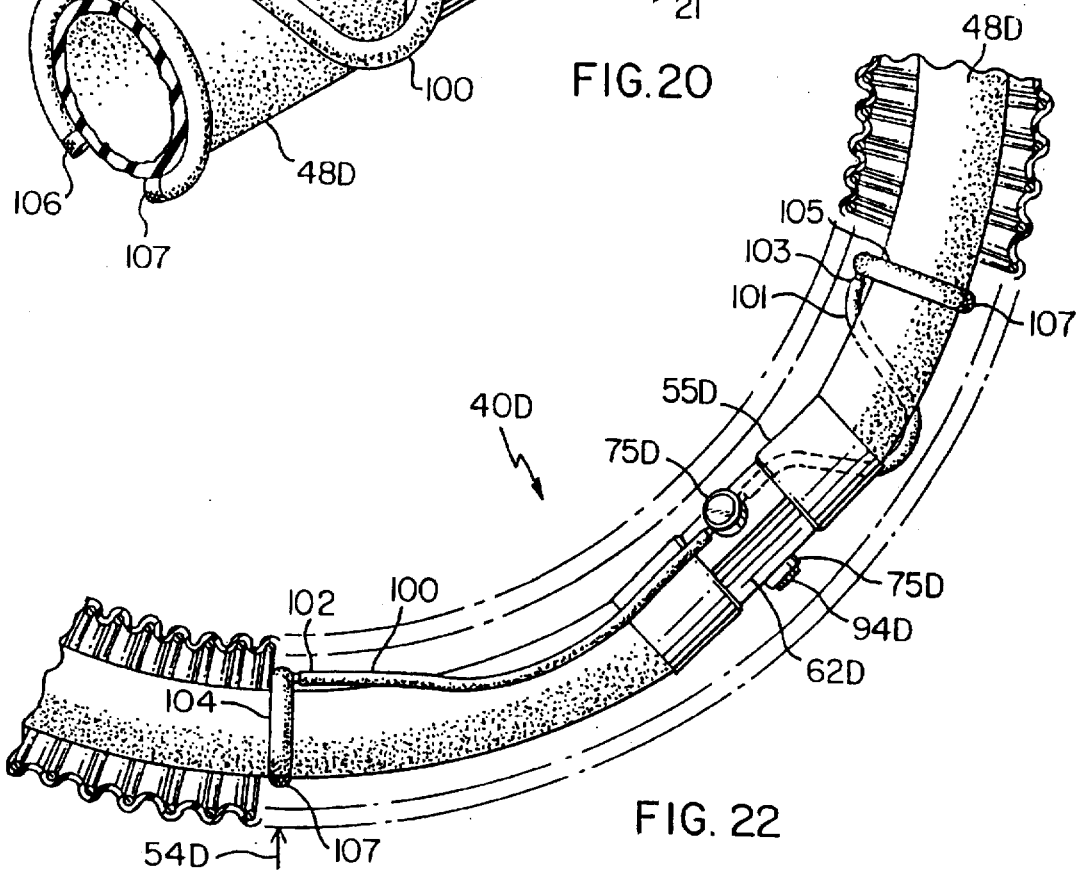
FIG. 22 is a view similar to FIG. 19 and illustrates another hose assembly of this invention utilizing the venturi section of FIG. 20.

Another liquid dispensing system of this invention is generally indicated by the reference numeral 40D in FIGS. 20–22 and parts thereof similar to the parts of the fuel dispensing systems 40–40C previously described are indicated by like reference numerals followed by the reference letter "D".

As illustrated in FIGS. 20–22, the system 40D is similar to the system 40A in that only two of the inlet members 75D for the venturi section 55D have flexible tubes 100 and 101 extending in opposite directions from the venturi section 55D with their outer ends 102 and 103 being interconnected to C-shaped tubes 104 and 105 which respectively have filtered inlet ends 106 and 107 spaced from each other but encircling the inner hose 48D throughout an arc greater than 180 degrees so that each C-shaped member 104 or 105 through the weight of the filtered inlet ends 106 and 107 thereof will rotate on the inner hose 48D so as to position the inlet ends 106 and 107 downwardly by gravity and permit the particular C-shaped member 104 or 105 to move on the inner hose 48D toward the actual low drape area 54D through gravity as illustrated in FIG. 22.

The remaining inlet member 75D of the venturi section 55D has the filter 94D for sucking liquid into the venturi throat 71D when that filter 94D is disposed at the actual low drape area 54D which would be the normal low drape area for the hose assembly 43D as illustrated in FIG. 1. However, the C-shaped inlet member 104 would be disposed at the actual low drape area 54D under the conditions of FIG. 3 and the other C-shaped member 105 would be disposed at the low drape area 54D under the conditions of the hose assembly 43D of FIG. 2.

Therefore, it can be seen that the venturi section 55D provides three pick-ups that would be similar to the three pick-ups 59, 60 and 61 of the venturi section 55 previously described except that the appropriate C-shaped member 104 or 105 will move to the actual low drape area 54D in a manner similar to the wheeled member 96 previously described.

Figure 27:
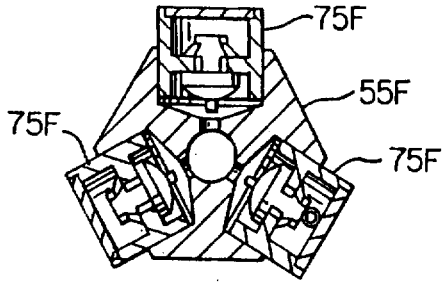
FIG. 27 is a cross-sectional view taken on line 27—27 of FIG. 26.
Figure 26:
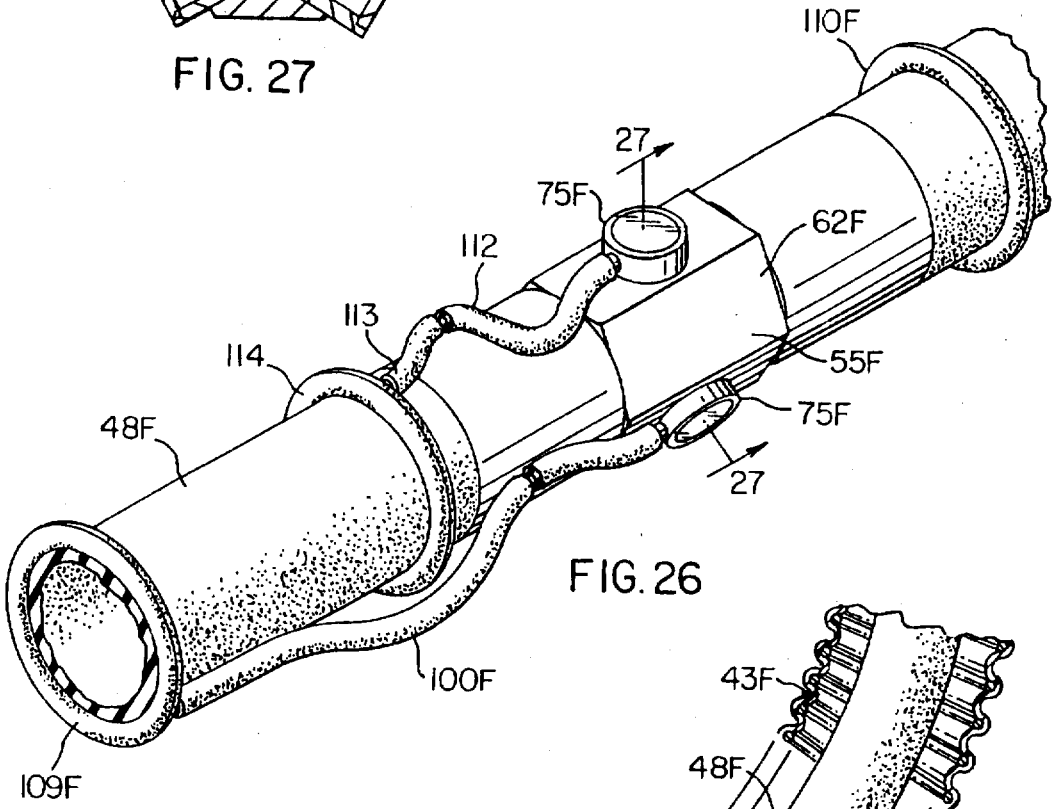
FIG. 26 is a view similar to FIG. 23 and illustrates another venturi section of this invention.
Figure 28:
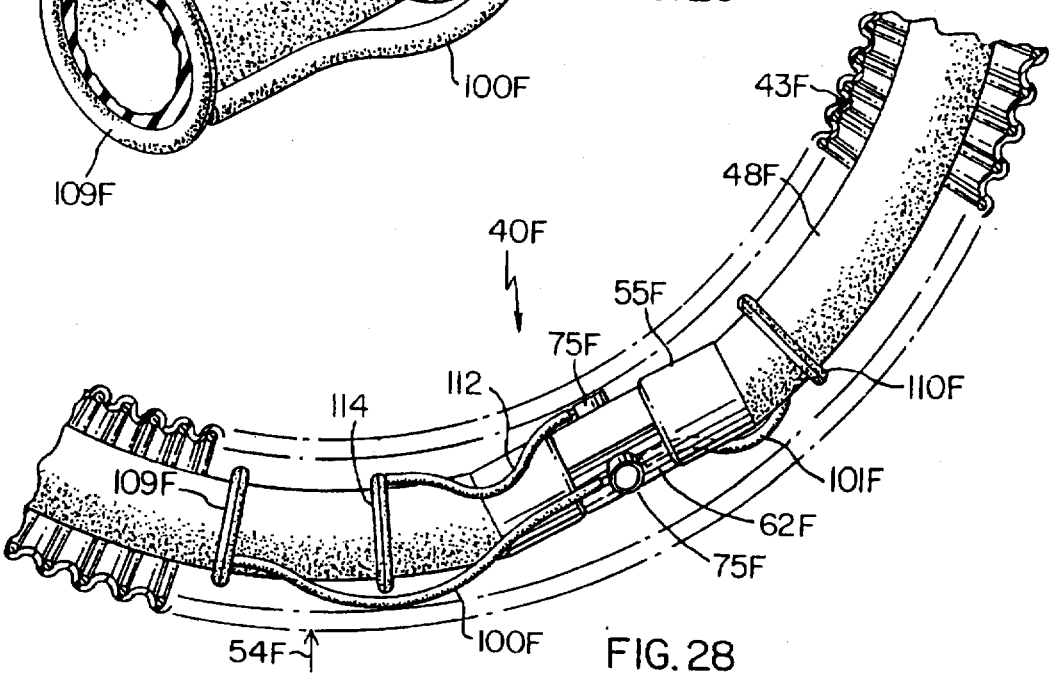
FIG. 28 is a view similar to FIG. 25 and illustrates another hose assembly of this invention utilizing the venturi section of FIGS. 26 and 27.

If desired, a tubular member and C-shaped member can be provided for all three ports of venturi section 55D if desired such as illustrated in FIGS. 26–28 and hereinafter described. Conversely, the fixed inlet member 75D that has the filter member 94D could be eliminated, if desired, as one or both members 104 and 105 will move close to the medial portion 62D of the venturi section 55D if the medial portion 62D is positioned at the actual drape area 54D.

It can be seen that the ring members 104 and 105 are respectively fluidly interconnected to the tubes 100 and 101 by joining nipple means 108 as illustrated in FIG. 20 or any other suitable means can be provided, if desired.

Figure 24:
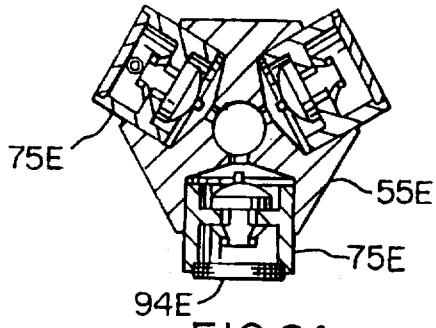
FIG. 24 is a cross-sectional view taken on line 24—24 of FIG. 23.
Figure 23:
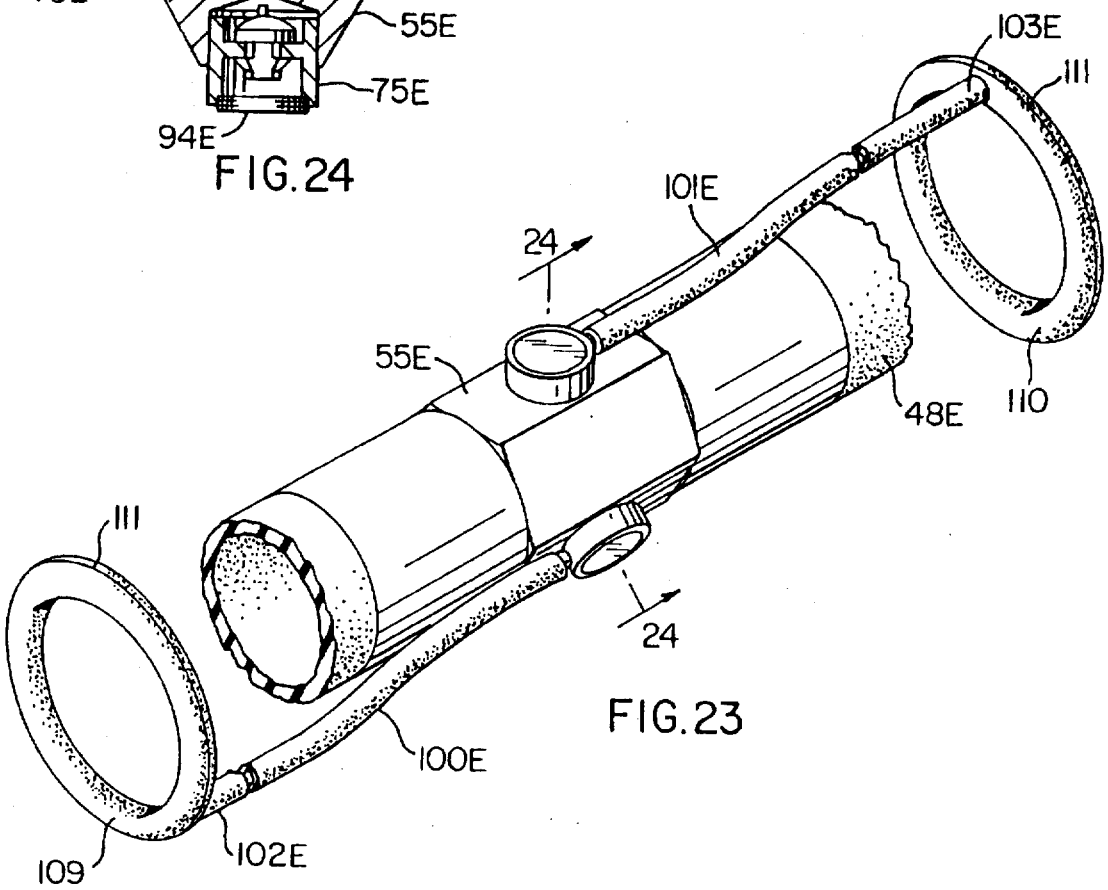
FIG. 23 is a view similar to FIG. 20 and illustrates another venturi section of this invention.
Figure 25:
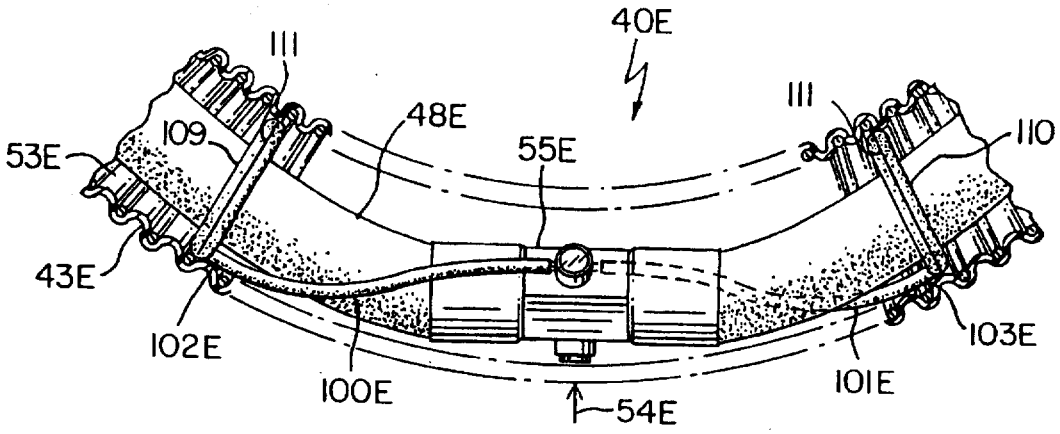
FIG. 25 is a view similar to FIG. 22 and illustrates another hose assembly of this invention utilizing the venturi section of FIGS. 23 and 24.

Another fuel dispensing system of this invention is generally indicated by the reference numeral 40E in FIGS. 23–25 and parts thereof similar to the parts of the fuel dispensing systems 40–40D previously described are indicated by like reference numerals followed by the reference letter "E".

As illustrated in FIGS. 23–25 the system 40E is substantially identical to the system 40D except that the flexible tubes 100E and 101E have the ends 102E and 103E thereof respectively interconnected by nipple means (not shown) to completely annular members 109 and 110 that have the hollow interiors thereof interconnected to the exterior thereof by an inlet slit means 111 that extends substantially all the way around the entire annular member 109 or 110 as illustrated, the members 109 and 110 being of a sufficient size to permit the same to completely encircle the inner hose 48E and slide thereon by gravity so as to position themselves at the actual low drape area 54E in a manner similar to the C-shaped members 104 and 105 as previously described.

Thus, it can be seen that the venturi section 55E functions in substantially the same manner as the venturi section 55D previously described to remove liquid from the vapor recovery passage 53E in any of the conditions of the hose assembly 43E as represented by the three positions illustrated in FIGS. 2–3 as well as when the actual drape area 54E is somewhere other than those three particular locations.

Another fuel dispensing system of this invention is generally indicated by the reference numeral 40F in FIGS. 26–28 and parts thereof similar to parts of the systems 40–40E previously described are indicated by like reference numerals followed by the reference letter "F".

The system 40F is substantially identical to the system 40D previously described except that instead of only having two tubes 100F and 101F extending in opposite directions from the venturi section 55F as for the venturi section 55E previously described, the remaining inlet member 75F has a tube 112 interconnected thereto and having its end 113 interconnected to a third annular member 114 which functions in the same manner as the annular members 109F and 110F to provide a third pick-up for the venturi section 55F as illustrated in FIG. 28 as the annular member 114 will slide on the inner hose 48F intermediate the venturi section 55F and the member 109F rather than relying on a medial portion 62F of the venturi section 55F for the intermediate pick-up for the venturi section 55F.

Figure 30:
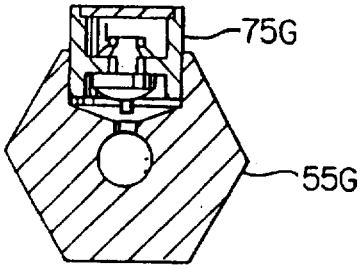
FIG. 30 is a cross-sectional view taken on line 30—30 of FIG. 29.
Figure 29:
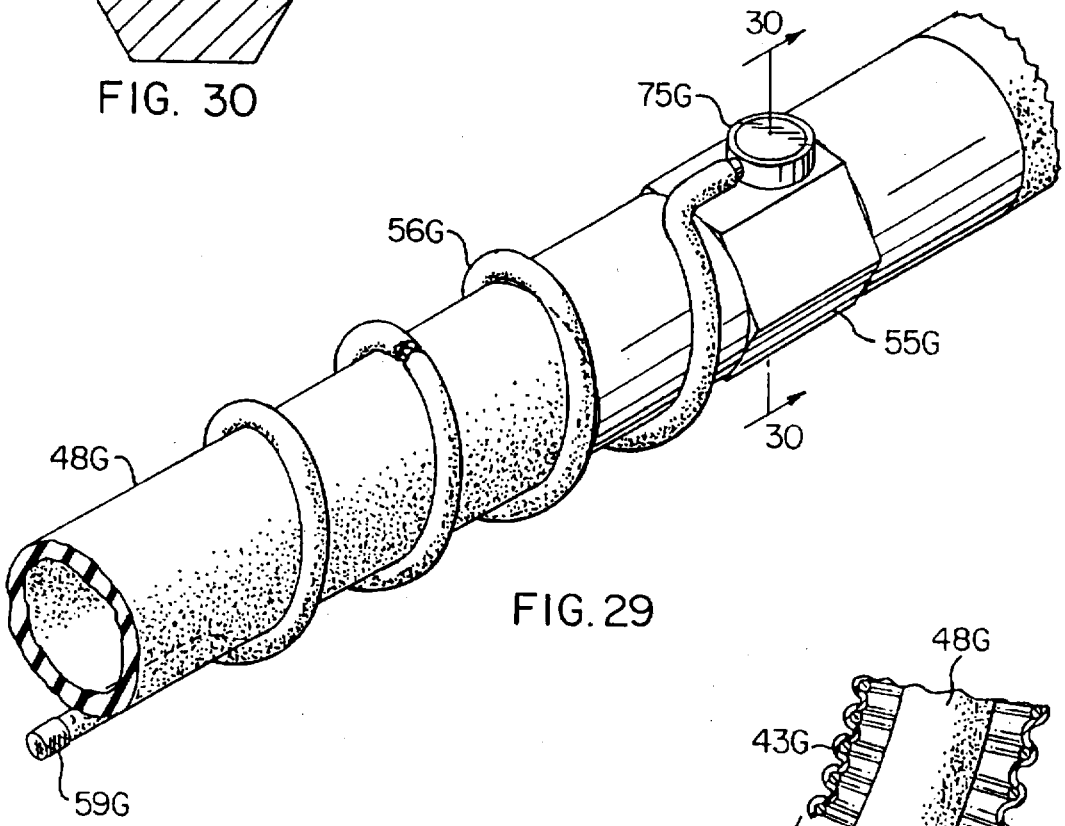
FIG. 29 is a view similar to FIG. 26 and illustrates another venturi section of this invention.
Figure 31:
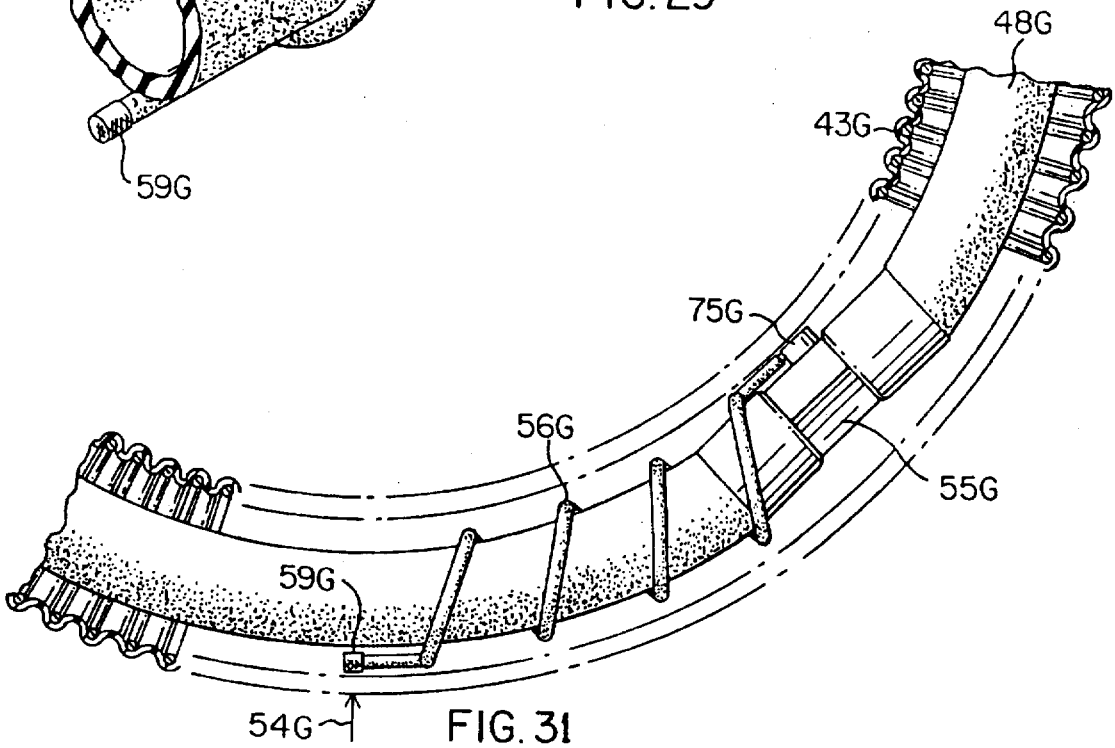
FIG. 31 is a view similar to FIG. 28 and illustrates another hose assembly of this invention utilizing the venturi section of FIGS. 29 and 30.

Another fuel dispensing system of this invention is generally indicated by the reference numeral 40G in FIGS. 29–31 and parts thereof similar to parts of the fuel dispensing systems 40–40F previously described are indicated by like reference numerals followed by the reference letter "G".

As illustrated in FIGS. 29–31, the venturi section 55G of the hose assembly 43G has only a single flexible tube 56G interconnected to a single inlet member 75G for the venturi section 55G in a manner similar to the single tube 56C of system 40C previously described.

However, the single tube 56G is loosely coiled in a helical manner about the inner hose 48G so that its outlet end 59G will tend to position itself by gravity at the actual low drape area 54G for the hose assembly 43G regardless of whether the hose assembly 43G has the actual low drape area 54G being the normal low drape area thereof as illustrated in FIG. 1 or one of the drape areas as illustrated in FIGS. 2 or 3 or in another location as the filtered end 59G will seek such actual low drape area 54G by gravity in the same manner as the wheeled member 96 previously described.

Therefore, it can be seen that the inlet end 59G of the tube 56G will always be generally at the actual low drape area 54G of the hose assembly 43G in the same manner that the wheeled vehicle 96 of the system 40C is positioned at the low drape area 54C.

Another fuel dispensing system of this invention is generally indicated by the reference numeral 40H in FIGS. 32–34 and parts thereof similar to parts of the fuel dispensing systems 40–40G previously described are indicated by like reference numerals followed by the reference letter "H".

As illustrated in FIGS. 32–34, the venturi section 55H of the hose assembly 43H has a plurality of flexible tubes 56H, 57H and 58H being interconnected to a single inlet member 75H for the venturi section 55H by means of a manifold member 120 that has a plurality of inlet plugs 121 respectively disposed in the ends 87H of the tubes 56H–58H and fluidly interconnecting with a tubular connector 84H of the single inlet member 75H of the venturi section 55H in a manner similar to the single tube 56B of the system 40B previously described.

The inlet ends of the tubes 56H–58H respectively carry the stone filters 59H–61H to cause the ends 59H–61H to fall to the bottom of the outer hose 51H in the manner illustrated in FIG. 34 wherein it can be seen that the filter 60H of the tube 57H is disposed at the actual low drape area 54H while the venturi section 55H is disposed intermediate the low drape area 54H and where the dispensing nozzle would be located in a manner similar to the arrangements illustrated in FIGS. 6 and 16 whereby the manifold 120 is adapted to couple a plurality of inlet tubes 56H–58H to the single inlet member 75H of the venturi section 55H.

Figure 36:
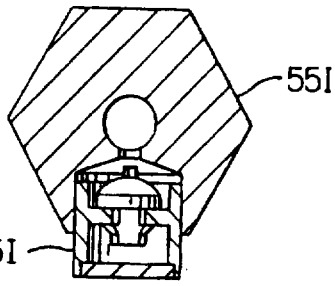
FIG. 36 is a cross-sectional view taken on line 36—36 of FIG. 35.
Figure 35:
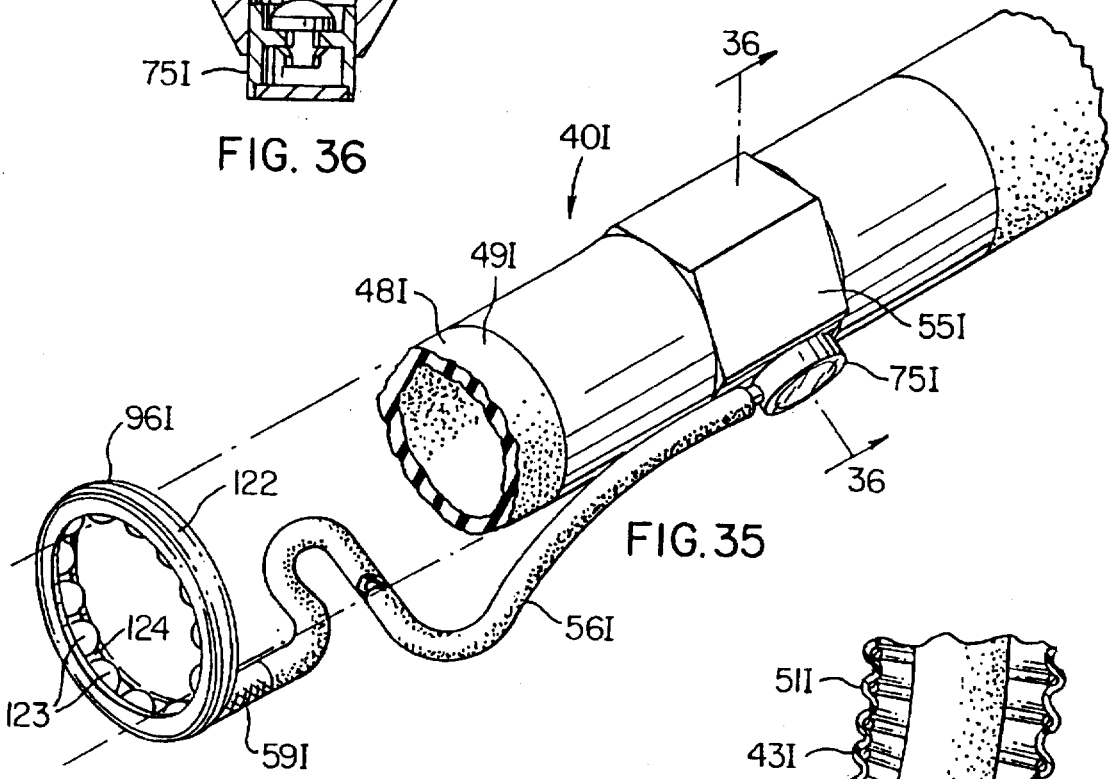
FIG. 35 is a view similar to FIG. 32 and illustrates another venturi section of this invention.
Figure 37:
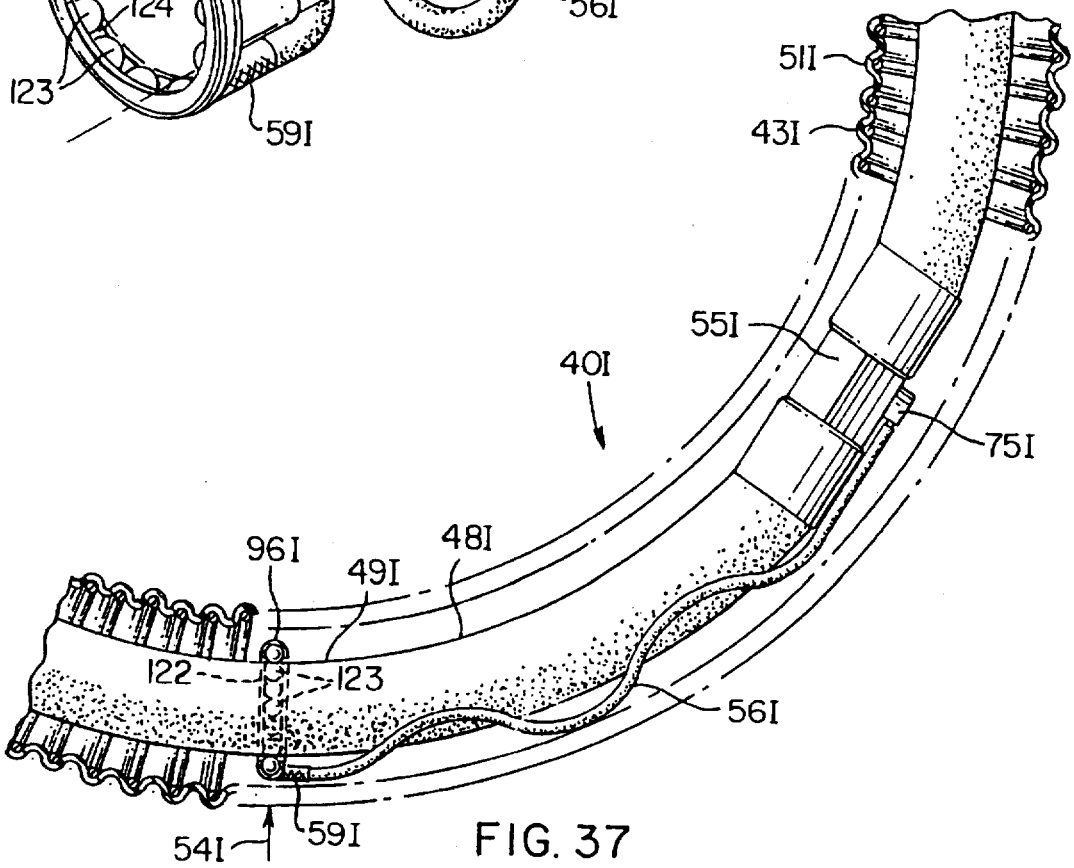
FIG. 37 is a view similar to FIG. 34 and illustrates another hose assembly of this invention utilizing the venturi section of FIGS. 35 and 36.

Another fuel dispensing system of this invention is generally indicated by the reference numeral 40I in FIGS. 35–37 and parts thereof similar to parts of the fuel dispensing systems 40–40H previously described are indicated by like reference numerals followed by the reference letter "I".

As illustrated in FIGS. 35–37, the venturi section 55I of the hose assembly 43I has only a single flexible tube 56I interconnected to a single inlet member 75I for the venturi section 55I in a manner similar to the single tube 56C of the system 40C previously described.

The stone filter 59I on the inlet end of the flexible tube 56I is interconnected to a wheeled member 96I that rolls on the inner hose 48I of the hose assembly 43I rather than on the internal peripheral surface of the outer hose 51I as provided by the wheeled member 96 of FIGS. 17–19.

The wheeled member 96I comprises an annular part 122 that is substantially C-shaped in cross section so as to contain therein a plurality of balls 123 in a manner similar to a raceway of a ball bearing so that the protruding portions of the balls 123 through an internal opening 124 of the C-shaped annular member 122 will engage against the external peripheral surface 49I of the inner hose 48I and permit the member 96I to in effect, roll thereon and thereby seek the lowest/actual drape area 54I of the hose assembly 43I by gravity in the manner illustrated in FIG. 37 to position the stone filter 59I of the flexible hose 56I substantially at the actual low drape area 54I in a manner similar to the wheeled member 96 previously described and for the same purpose as previously described.

Another fuel dispensing system of this invention is generally indicated by the reference numeral 40J in FIGS. 38–41 and parts thereof similar to parts of the fuel dispensing systems 40–40I previously described are indicated by like reference numerals followed by the reference letter "J".

As illustrated in FIGS. 38–41, the venturi section 55J of the hose assembly 43J has only a single flexible tube 56J interconnected to a single inlet member 75J for the venturi section 55J.

The single tube 56J for the hose assembly 43J is formed from a plurality of separate tubular parts 125, 126 and 127' coupled together by interconnecting stone filters 127, 128 each of which has opposed projecting portions 129 which are adapted to be respectively press-fittingly received in adjacent ends of the interconnecting sections 125, 126 or 126, 127' as illustrated in FIG. 40 so that the filters 127 and 128 can cooperate with the stone filter 59J at the outer end of the section 127' to provide three different pickups for the tube 56J to permit the tube 56J to have one of the items 127, 128 or 59J substantially at the actual low drape area 54J of the hose assembly 43J in substantially the same manner as the ends of the plurality of tubes 56–58 of the hose assembly 43 previously described.

Another fuel dispensing system of this invention is generally indicated by the reference numeral 40K in FIGS. 42–45 and parts thereof similar to parts of the fuel dispensing systems 40–40J previously described are indicated by like reference numerals followed by the reference letter "K".

As illustrated in FIGS. 42–45, the venturi section 55K of the hose assembly 43K has only a single flexible tube 56K interconnected to a single inlet member 75K for the venturi section 55K in a manner similar to the single tube 56J of the system 40J previously described except that the single tube 56K comprises one part having its end 87K that is interconnected to the projection 84K of the inlet member 75K provided with a filter 130 that is disposed inside the tube 56K so that the free end 131 of the tube 56K presents an opening that will lead to such inside filter 130.

In addition, the single tube 56K has openings 132 and 133 formed in spaced relation through the side walls thereof as illustrated in FIG. 4 so that the single tube 56K presents three openings 132, 133 and 131 to provide for three different pickups one of which is adapted to be located at the actual low drape area 54K for the hose assembly 43K in the same manner that the three pickups 59, 60 and 61 for the venturi section 55 are provided for the hose assembly 53 previously described or in the same manner that the pickups 127, 128 and 59J for the single tube 56J of the system 40J provides for three different areas of pickup for the reasons and purposes previously set forth.

Therefore, it can be seen that in all of the embodiments of this invention a venturi section is provided which will have inlet means that is positioned in the second or vapor recovery fluid passage generally at the actual drape area of the respective hose assembly even when the actual drape area is disposed intermediate the normal drape area and the nozzle of the hose assembly or is disposed intermediate the normal drape area and the fuel source for the hose assembly as well as when the actual drape area is disposed generally at the normal drape area thereof.

Thus, this invention not only provides a new liquid fuel dispensing system and method of making the same, but also this invention provides a new hose assembly for such a system and a new venturi section for such a hose assembly and methods of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim accordingly to this invention in the portion of each claim that is disposed after the terms "the improvement" whereby it is believed that each claim sets forth a novel, useful and unobvious invention within the purview of the Patent Statute.

What is claimed is:

1. In a hose assembly for a system comprising a liquid fuel source, a dispensing nozzle and said hose assembly that has a first fluid passage therein for conveying said liquid fuel in one direction from said source to said nozzle that is adapted to dispense said liquid fuel into a container and a second fluid passage therein for returning vapors associated with said liquid fuel from said container, said hose assembly comprising a flexible inner hose having an outer peripheral surface and defining said first fluid passage therein, and a flexible outer hose having an inner peripheral surface and being disposed around said inner hose, said inner peripheral surface of said outer hose and said outer peripheral surface of said inner hose defining said second fluid passage therebetween, said hose assembly having a venturi section therein that tends to remove liquid from a normal drape area of said hose assembly when the same is being utilized to dispense said liquid fuel into said container and an inlet member in said venturi section, the improvement wherein said venturi section has inlet means that is adapted to be positioned in said second fluid passage generally at the actual drape area of said hose assembly even when said actual drape area is disposed intermediate said normal drape area and said nozzle or is disposed intermediate said normal drape area and said source as well as when said actual drape area is disposed generally at said normal drape area, said inlet means comprising a single flexible tube interconnected to said inlet member in said venturi section, said tube comprising a plurality of separate tubular sections and a plurality of tubular filter elements interconnecting said tubular sections.

2. The hose assembly of claim 1 wherein at least one of said filter elements is disposed in said actual drape area, and at least one of said filter elements serving as pickup means for removing and filtering fluids from said actual drape area and passing said removed fluid through said flexible tube.

3. The hose assembly of claim 1 having an additional filter element at the end of said flexible tube which is farthest from said inlet member.

4. The hose assembly of claim 1 wherein at least one of said filter elements is gravity positioned in said actual drape area.

5. In a method of making a hose assembly for a system comprising a liquid fuel source, a dispensing nozzle and said hose assembly that has a first fluid passage therein for conveying said liquid fuel in one direction from said source to said nozzle that is adapted to dispense said liquid fuel into a container and a second fluid passage therein for returning vapors associated with said liquid fuel from said container, said hose assembly comprising a flexible inner hose having an outer peripheral surface and defining said first fluid passage therein, and a flexible outer hose having an inner peripheral surface and being disposed around said inner hose, said inner peripheral surface of said outer hose and said outer peripheral surface of said inner hose defining said second fluid passage therebetween, said hose assembly having a venturi section therein that tends to remove liquid from a normal drape area of said hose assembly when the same is being utilized to dispense said liquid fuel into said container and an inlet member in said venturi section, the improvement comprising the steps of forming said venturi section to have inlet means that is adapted to be positioned in said second fluid passage generally at the actual drape area of said hose assembly even when said actual drape area is disposed intermediate said normal drape area and said nozzle or is disposed intermediate said normal drape area and said source as well as when said actual drape area is disposed generally at said normal drape area, forming said inlet means of a single flexible tube, interconnecting said flexible tube to said inlet member of said venturi section, forming said tube of a plurality of separate tubular sections and a plurality of tubular filter elements, and placing said filter elements between said tubular sections to form said flexible tube.

6. The method of claim 5 comprising the further steps of disposing at least one of said filter elements in said actual drape area, utilizing the suction created by said venturi section to remove fluids through at least one of said filter elements from said actual drape area, and passing said removed fluids through said flexible tube into said venturi section.

7. The method of claim 5 comprising the further step of providing an additional filter element at the end of said flexible tube which is farthest from said inlet member.

8. The method of claim 5 comprising the further step of positioning at least one of said filter elements in said actual drape area by means of gravity.

* * * * *